US010737879B2

(12) United States Patent
McConnell et al.

(10) Patent No.: US 10,737,879 B2
(45) Date of Patent: Aug. 11, 2020

(54) WASTE DISPOSAL CONTAINER

(71) Applicant: 1316 LLC, Las Vegas, NV (US)

(72) Inventors: Thomas E. McConnell, Santa Ynez, CA (US); Qianqian Wang, Pizhou (CN); Yafei Lu, Jiangsu (CN)

(73) Assignee: 1316 LLC, Las Vegas, NV (US)

( * ) Notice: Subject to any disclaimer, the term of this patent is extended or adjusted under 35 U.S.C. 154(b) by 73 days.

(21) Appl. No.: 15/817,118

(22) Filed: Nov. 17, 2017

(65) Prior Publication Data

US 2019/0152694 A1 May 23, 2019

(51) Int. Cl.
*B65F 1/06* (2006.01)
*B65F 1/16* (2006.01)

(52) U.S. Cl.
CPC ..... *B65F 1/06* (2013.01); *B65F 1/16* (2013.01); *B65F 1/163* (2013.01); *B65F 2210/129* (2013.01); *B65F 2210/1675* (2013.01); *B65F 2220/106* (2013.01); *B65F 2230/108* (2013.01); *B65F 2250/00* (2013.09)

(58) Field of Classification Search
CPC ..... B65F 1/06; B65F 1/0006; B65F 1/163; B65F 1/067; B65F 1/141; B65F 1/1415; B65F 2210/129; B65F 2220/106; B65F 2230/108
USPC ..... 220/495.01, 495.06, 495.08, 908, 908.1, 220/908.3
See application file for complete search history.

(56) References Cited

U.S. PATENT DOCUMENTS

2016/0060026 A1* 3/2016 McConnell ..... B65F 1/0006 220/495.08

* cited by examiner

*Primary Examiner* — Elizabeth J Volz
(74) *Attorney, Agent, or Firm* — WPAT, P.C., Intellectual Property Attorneys; Anthony King

(57) ABSTRACT

A waste disposal container of smaller shipping profile is disclosed with an inner rotating support structure and an outer casing, where the inner rotating support structure and/or the outer casing may be shipped in separable parts and reassembled by the end consumer. The inner rotating support structure also may offer at least one bag attachment points to hold on to the body of the bag where the bag attachment points are designed to be lower to accommodate collection of cat litter.

20 Claims, 39 Drawing Sheets

WASTE DISPOSAL CONTAINER

FIELD OF THE DISCLOSURE

The field of the disclosure is waste disposal container.

BACKGROUND OF THE DISCLOSURE

Waste disposal containers are known. There continues to be a need for new designs for waste disposal containers tailored for specific types of waste.

There also continues to be a need for new ways to reduce the shipping costs of waste disposal containers.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In one embodiment, a waste disposal container is contemplated as having a base with a rotating plate capable of a rotational movement along with a support structure which is coupled to the rotating plate. The contemplated waste disposal container may have an actuator to control the rotational movement of the rotating plate, and it may have an outer casing coupled to the base. There is also contemplated a top lid coupled to the outer casing.

In one embodiment, the rotational movement of the rotating plate causes the support to rotate with the rotating plate simultaneously. It is also contemplated that there can be at least one catch coupled to the support which a disposable bag may attach to.

In some embodiments, a movement of the top lid is independent of the rotational movement of the rotating plate.

There can be a frame assembly coupled to the outer casing and disposed above the support. The frame assembly can include a roller base and a bag roller. The bag roller can be rotatable both clock-wise and counter clock-wise relative to the roller base. In operation, a top rim of a disposable bag can be fastened to the bag roller which can rotate at least 270 degrees relative to the roller base. This can in turn rotate the top rim of the disposable bag. In some embodiments, the bag roller can rotate at least 180 degrees relative to the roller base if the bag were initially installed in a way to create a partial twist. In this way, the additional rotation by the bag roller further completes a tight seal in the twisted neck. In other embodiments, the bag roller can rotate at least at various degrees so long as it can sufficiently rotate the top rim of the disposable bag to create a twisted neck in the disposable bag.

With respect to the support which is coupled to the rotating plate, there may be various different embodiments of the support. Some of the embodiments include at least one vertically raised rod. There can also be at least one circular frame attached to the at least one vertically raised rod.

In other embodiments, the support can include a circular wall coupled to the rotating plate. The circular wall can be a tall wall or a short wall. The circular wall can be provided in addition to having vertically raised rods and a circular ring.

In some specifically contemplated embodiments, the vertically raised rods can be collapsible and/or removable.

Many other structure types may be used in place of or together with vertically raised rods. For example, the support can include at least one vertically raised plate.

The support itself may act as a support frame to hold a disposal bag along with the content of the bag. The support may keep the bag away from touching the interior side wall of the outer casing. This is important because when the support rotates it is best that the bag does not brush up against the interior wall of the outer casing. If the bag does brush up against the interior wall of the out casing, it may undesirably slow down or stop the rotation.

In other embodiments, the support can additionally have a pliable material covering all or parts of the support, wherein the pliable material can be selected from a group consisting of a fabric, a mesh, and a film. In one embodiment, the pliable material is in a tubular form, such as a fabric liner stretched in a vertical direction. In another embodiment, the pliable material is in a tubular form with a closed bottom end, such as a fabric bag liner propped up by the support.

In yet another embodiment, even the outer casing can have a collapsible structure such as a pliable material covering the entire height or just a section of the entire height of the outer casing. This pliable material can be any one of a fabric, a mesh, and a film. In one embodiment, the pliable material is in a tubular form, such as a fabric outer wall propped up with some kind of skeleton. In other words, in some embodiments, the outer casing can have a fabric wall allowing the height of the outer casing to be collapsible when needed, as opposed to an outer casing entirely made of hard solid material such as plastic. Any concept disclosed herein for a collapsible support can also be implement to achieve a collapsible outer casing.

One contemplated concept of this disclosure is to make a waste disposal container collapsible and/or capable of being easily disassembled into a smaller profile. As such, some embodiments provide an outer casing and a support that are collapsible. Further, the support can be a collapsible framework.

Further, the outer casing can have an upper portion and a lower portion. Both the upper portion and the lower portion can be physically separated from each other. Optionally, the upper portion can be sized to fit partially or entirely within an inside of the lower portion. The top lid can be sized to fit partially or entirely within the inside of the lower portion and/or an inside of the upper portion.

As discussed earlier, there may be many support types that can be enclosed within the outer casing. The support can include at least one selected from a group consisting of at least one vertical rod, at least one vertical plate, at least one circular wall, at least one circular frame, a tubular frame, a short wall, a tall wall, a network, a netting, and a framework. Any one of the contemplated support type can have a height. The support can be collapsible in turn lowering or shorten the height of the support.

In a general embodiment, there can be at least one catch disposed on the support, said at least one catch is adapted to make engaging coupling with a waste disposal bag.

In a more specific embodiment, the support includes at least one vertical rod coupled to the circular frame, wherein at least one connector is coupled to the circular frame, and at least one catch adapted to make engaging coupling with a waste disposal bag is disposed on the support.

Another aspect of the embodiment is directed to methods of reducing a shipping dimension of a waste disposal container. The novel method is contemplated to include the step of providing a waste disposal container such as any embodiments disclosed herein. The novel method can include the step of providing an upper portion sized to nest either partially or entirely within said lower portion of the outer casing.

In a further embodiment, providing a top lid sized to nest either partially or entirely within said lower portion and/or upper portion of the outer casing.

In yet a further embodiment, taking the step to nest the top lid at least partially within said upper portion and/or said lower portion. Optionally, taking the step to nest the lower portion at least partially within said lower portion to produce a low profile nested disassembled parts.

In some embodiments, the upper and bottom portions of the outer casing each has a top opening and a bottom opening such that when they are disassembled, they each have a generally tubular shape.

In yet a further embodiment of the disclosed novel method, the novel method includes nesting the upper portion into the lower portion can include inserting the upper portion through the bottom opening and not the top opening of the lower portion.

The upper portion can have a tapered tubular shape such that its top opening has a diameter that is smaller than the diameter of its bottom opening. Similarly, the lower portion can have a tapered tubular shape such that its top opening has a diameter that is smaller than the diameter of its bottom opening. In this way, the top part of the top portion may fit through the bottom opening of the bottom portion effectively enclosing or nesting the top portion within the lower portion entirely or at least partially.

Various objects, features, aspects and advantages of the present embodiment will become more apparent from the following detailed description of embodiments of the embodiment, along with the accompanying drawings in which like numerals represent like components.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

Figure 1:
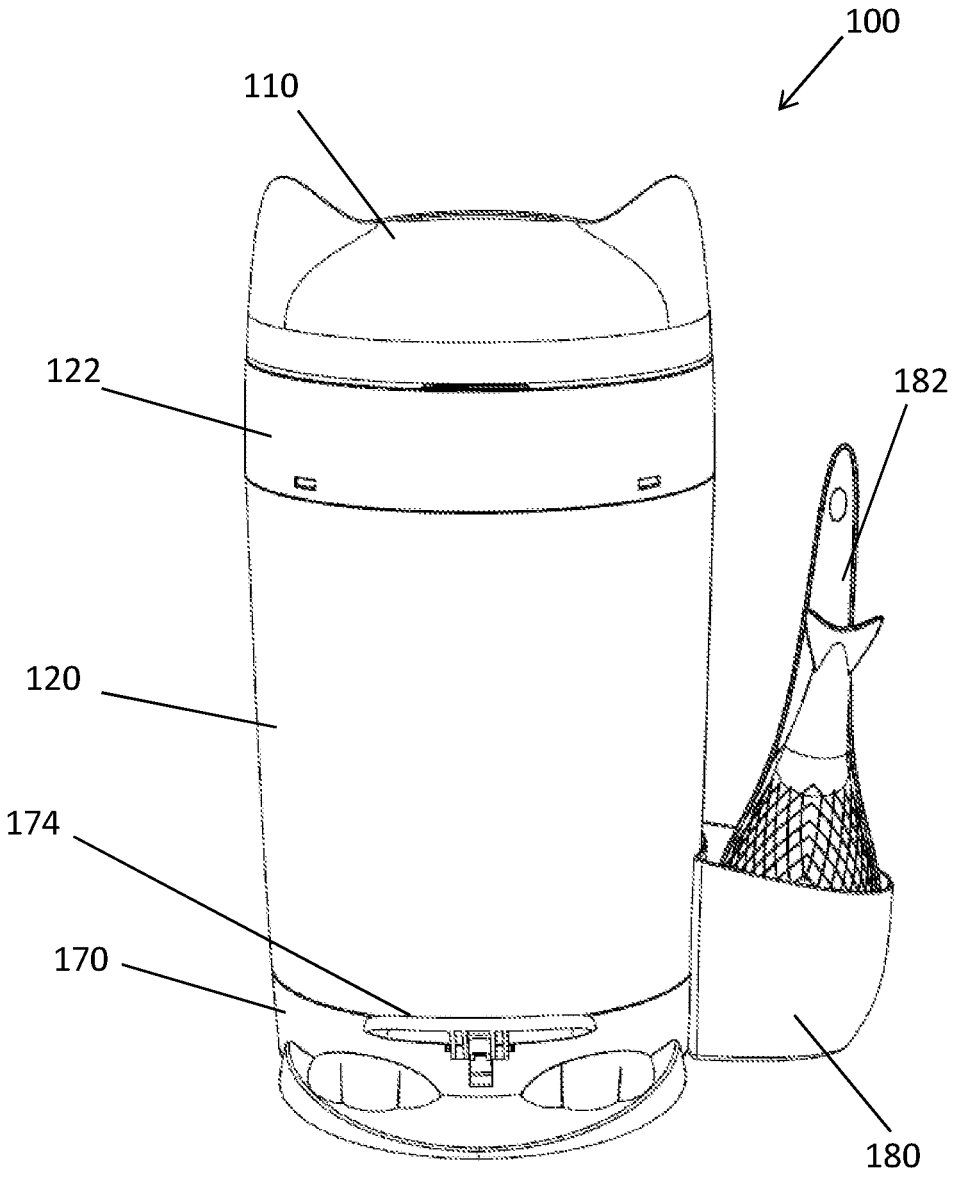
FIG. 1 is a front perspective view of an embodiment of a waste disposal container having a side scooper holder holding a scooper, according to an aspect of one embodiment.

The following call out list of elements in the drawing can be a useful guide when referencing the elements of the drawing figures:

100 Waste Disposal Container
110 Top lid
112 Odor control box
114 Lid for the odor control box
120 Outer casing
122 Bag roller body
123 Upper portion of the outer casing
124 Lower portion of the outer casing
130 Catch
132 Bag roller
134 Roller base
136 Knob
141 Circular frame
142 Rod
143 Connector
144 Half-circular frame
145 Connector
146 Rod
147 Extender
148 Circular frame
149 Connector
150 Pliable liner
151 Bottom connector
152 Bottom circular frame
153 Wall
154 Rod
155 Circular frame
156 Rod
157 Vertically raised plates
158 Tunnel
159 Bottom ring
170 Base
172 Rotating plate
173 Receiver
174 Foot pedal
175 Raised wall
180 Scooper holder
182 Scooper
184 Top half of the fish scooper
186 Top half of the mouse scooper
188 Bottom half of the scooper

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

FIG. 1 generally depicts one embodiment of the waste disposal container 100 having an exterior design that resembles a cat. It can have a top lid 110 with two cat ears, and a base 170 having two cat feet. In other embodiments, the top lid 110 does not have the cat ears.

Between the top lid 110 and the base 170 is an outer casing 120. Attached to the base 170 is a scooper holder 180 which holds a scooper 182. The scooper 182 can be used as a cat litter scooper, and the disposal container 100 can be used to hold a disposable bag that collects cat litter. The various embodiments described herein provide a fun and easy way to contain cat litter while keeping odor out.

Figure 2:
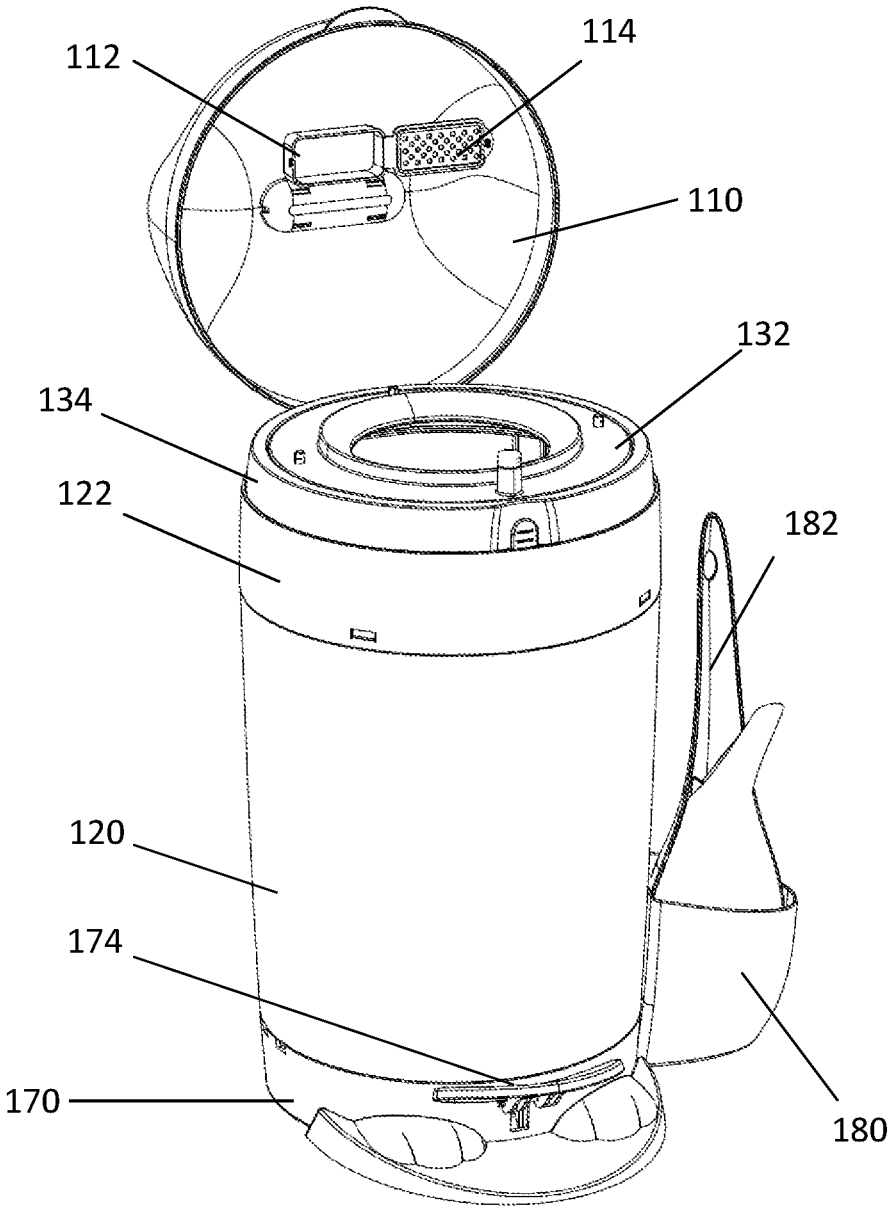
FIG. 2 is a front perspective view of the embodiment of FIG. 1, wherein the top lid is open, and the lid of an odor control box located under the top lid is also open, according to an aspect of one embodiment.
Figure 3:
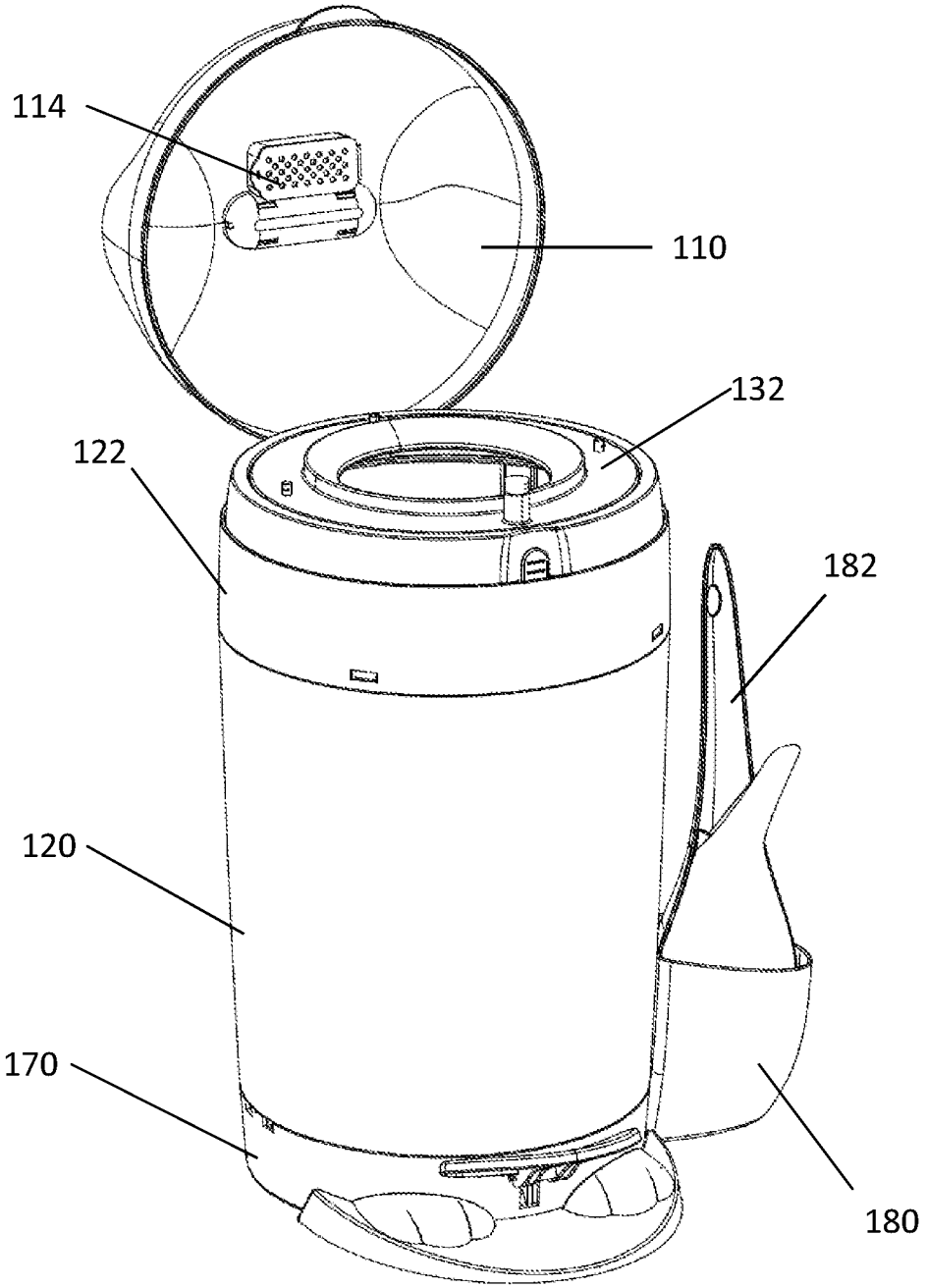
FIG. 3 is a front perspective view of the embodiment of FIG. 1, wherein the top lid is open, and the lid of an odor control box located under the top lid is closed, according to an aspect of one embodiment.

Referring now to FIG. 2, the top lid 110 can have an odor control box 112 to hold an deodorizing agent and a lid 114 to keep the deodorizing agent within the odor control box 112. FIG. 3 shows the lid 114 being closed on the odor control box 112.

In one embodiment, the top lid 110 may be mechanically or electrically actuated. In yet another embodiment, the top lid 110 can be pivotably connected to the rest of the waste disposal container 100 and can be manually opened by simply lifting the top lid 110 by hand. In one particular embodiment, a user can step on the food pedal 174 to turn the inner support (to be discussed below) and would not affect opening/closing of the top lid 110. In other words, opening/closing of the top lid 110 can be independent of a rotational movement of the inner support (to be discussed below).

When the top lid 110 is open, a bag roller 132 is exposed. In the middle of the bag roller 132 is an aperture through which waste material such as cat litter can be deposited.

Figure 4A:
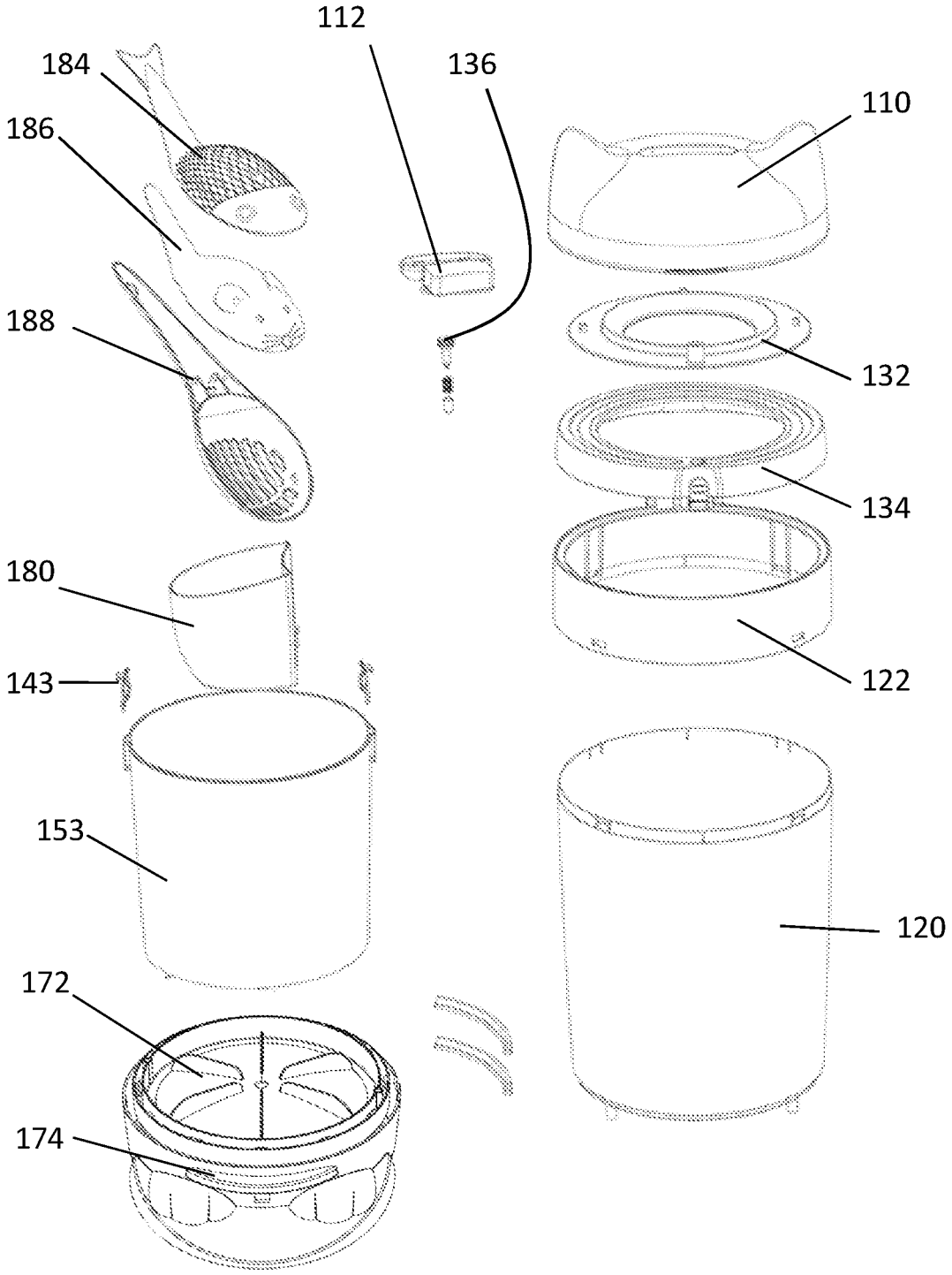
FIG. 4A is an exploded view of the embodiment of FIG. 1 showing various inner and outer components of one embodiment.

FIG. 4A illustrates the various components in one contemplated embodiment. Here, outer casing 120 is shown as one single barrel-like structure. This disclosure will discuss and expand on the various contemplated designs possible for this barrel-like outer casing 120.

Figure 4B:
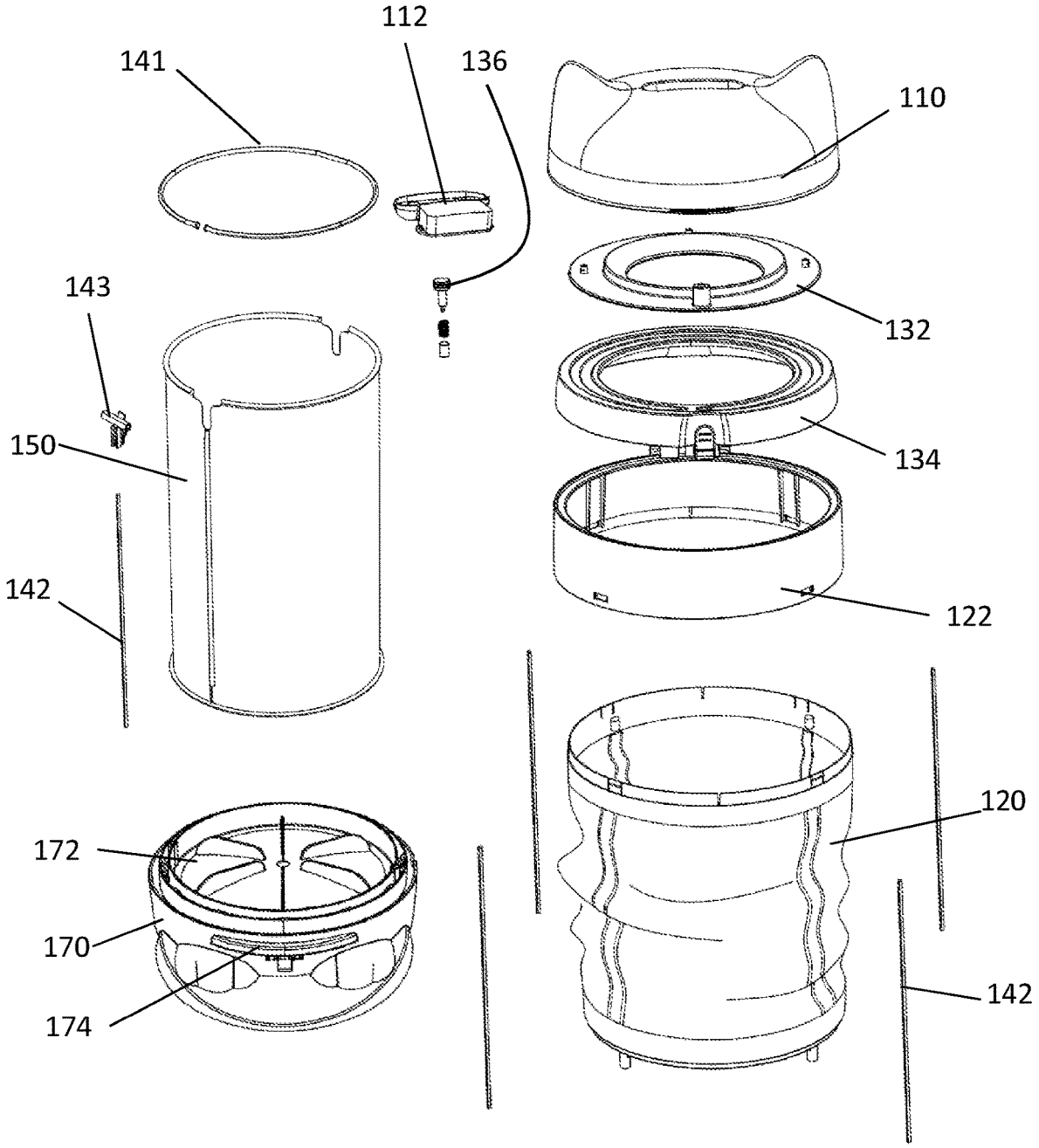
FIG. 4B is another exploded view of one embodiment where even the outer casing is collapsible.
Figure 19:
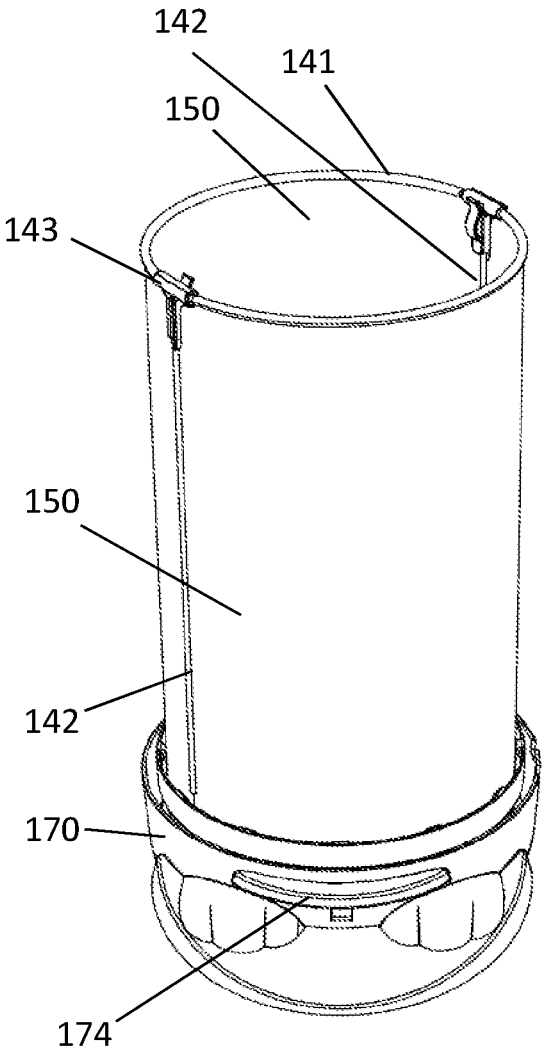
FIG. 19 is a perspective view of still another embodiment of a support using two tall vertical rods, a circular frame, and a pliable liner, according to one aspect of the disclosed embodiments.
Figure 20:
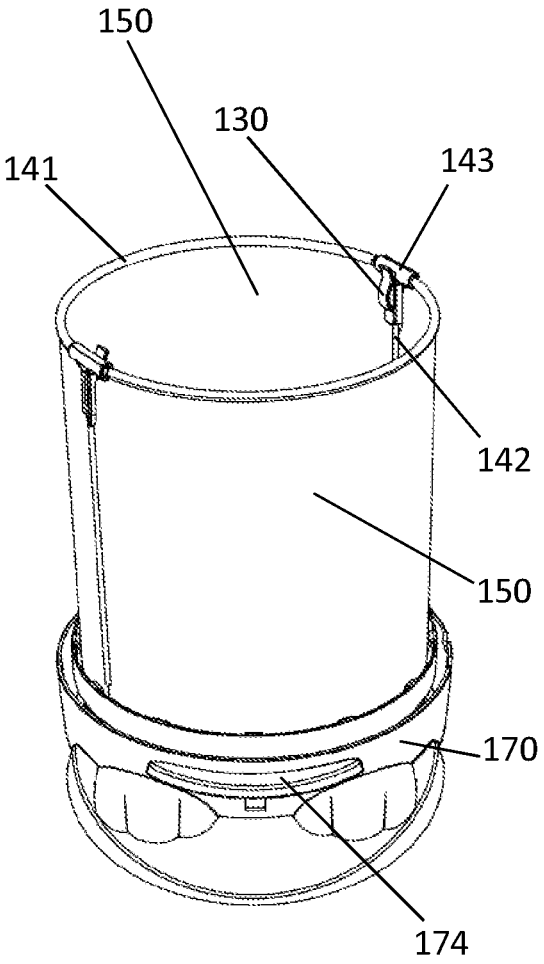
FIG. 20 is a perspective view of still another embodiment similar to that of FIG. 19, only shorter, according to one aspect of the disclosed embodiments.
Figure 21:
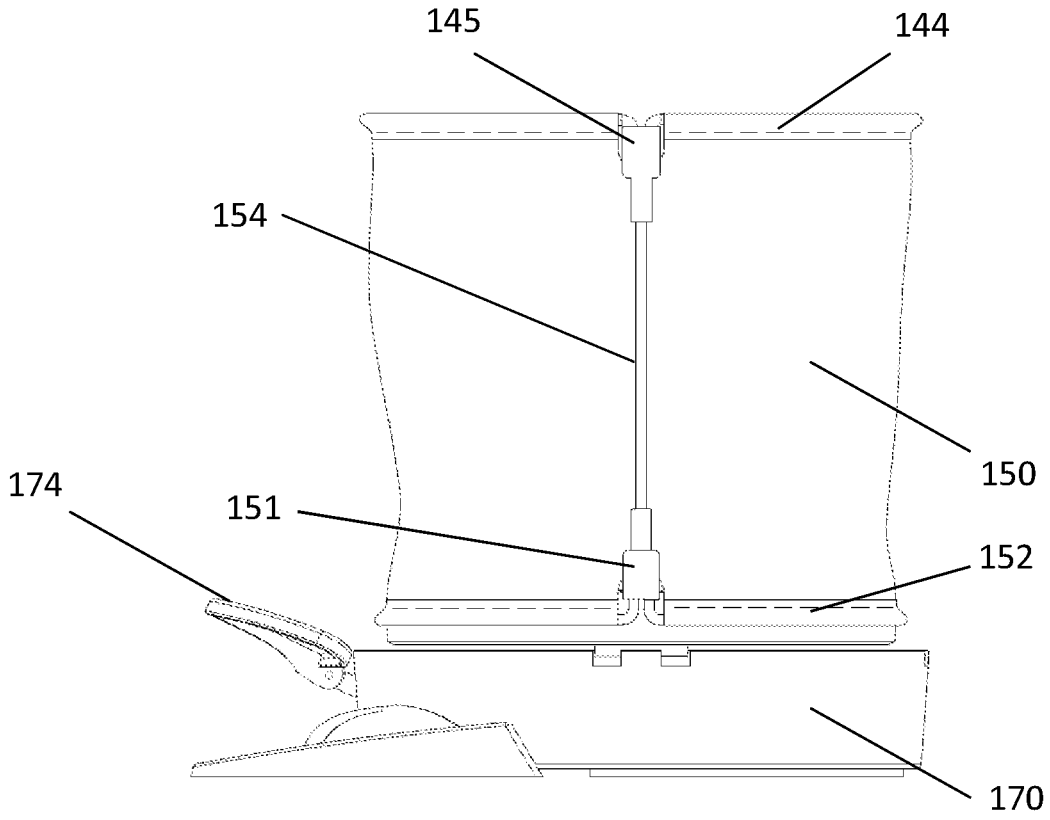
FIG. 21 is a side view showing a further embodiment of a support using a circular frame, two short vertical rods, and a pliable liner, according to one aspect of the disclosed embodiments.

In a particular embodiment as shown in FIG. 4B, the barrel-like outer casing 120 can be collapsible, with similar design and material to the wall 150 of the collapsible inner barrel as shown in FIGS. 19-21. The collapsible outer casing 120 can be made of any material such as pliable fabric and can be propped up into a barrel shape by rods 142. This collapsible outer casing can have rigid or non-rigid upper and/or lower rims having complementary structure to couple with the base 170 and bag roller body 122.

Another key aspect of this disclosure is the tubular wall 153 structure which acts as a support to contain a bag of waste. Throughout this disclosure various different designs of this support structure will be discussed.

As for the bag roller 132 and how a disposable bag is installed and used in the contemplated waste disposal container 100, a method of attaching a disposable bag using a rotatable bag roller is disclosed in U.S. Patent Application Publication Nos. US2016/0060026A1 and 2016/0060029A1 (both of which are incorporated by reference in their entireties) in which the combination of a bag roller and a rotatable inner barrel creates a twisted neck in the disposable bag, effectively sealing odor from escaping.

Figure 5:
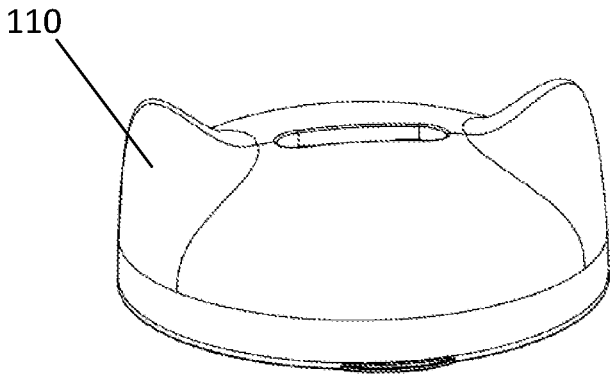
FIG. 5 is a perspective view of the top lid of FIG. 1.
Figure 6:
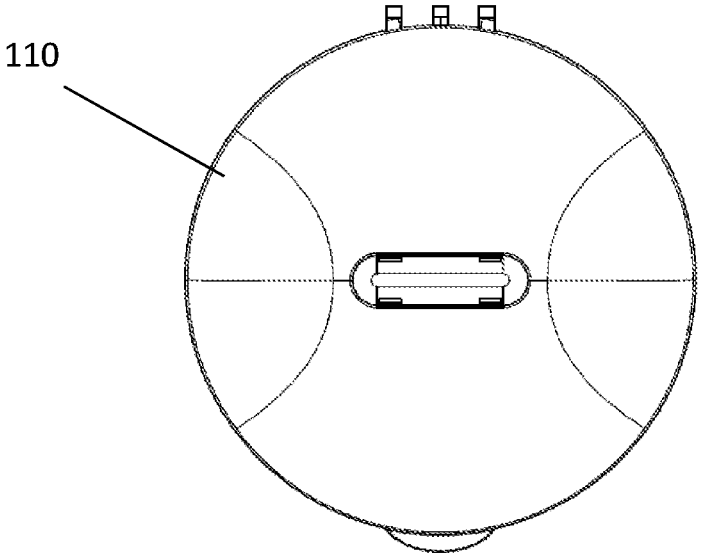
FIG. 6 is a top view of the top lid of FIG. 1.

Although the top lid 110 is shown in FIGS. 5 and 6 as having two protruding ear-like designs, there can be other embodiments without have any such designs.

Figure 7:
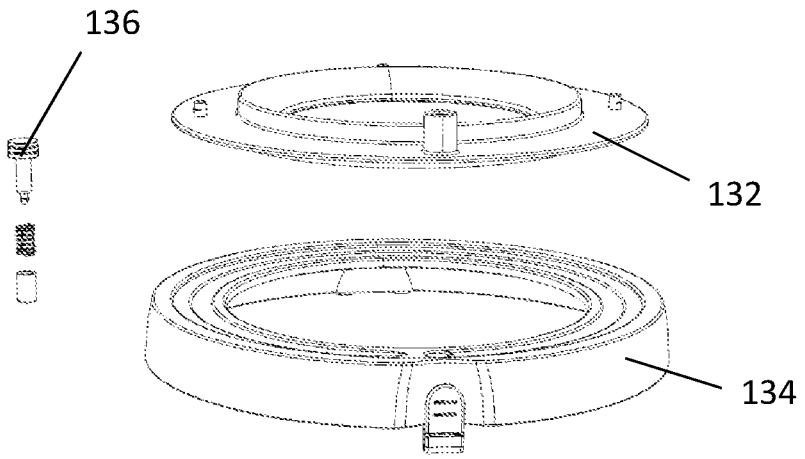
FIG. 7 is an exploded view of a frame assembly which has a bag roller and a bag frame.
Figure 8:
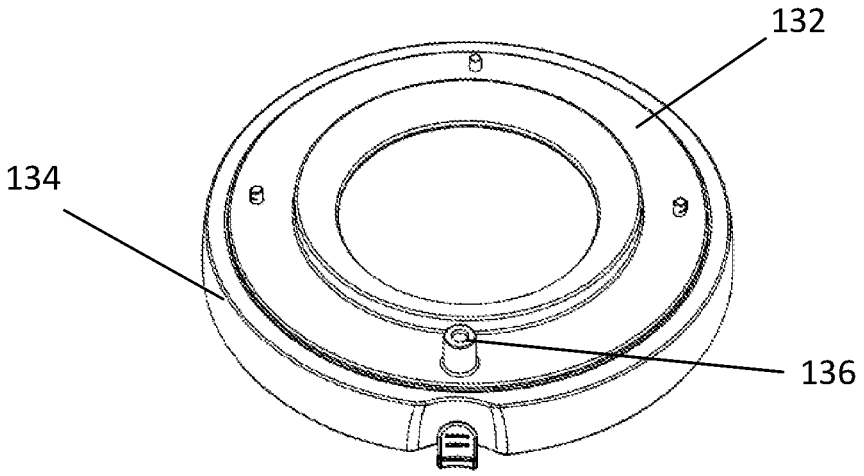
FIG. 8 is a perspective view of the frame assembly of FIG. 6 where the bag roller is in a first position.
Figure 9:
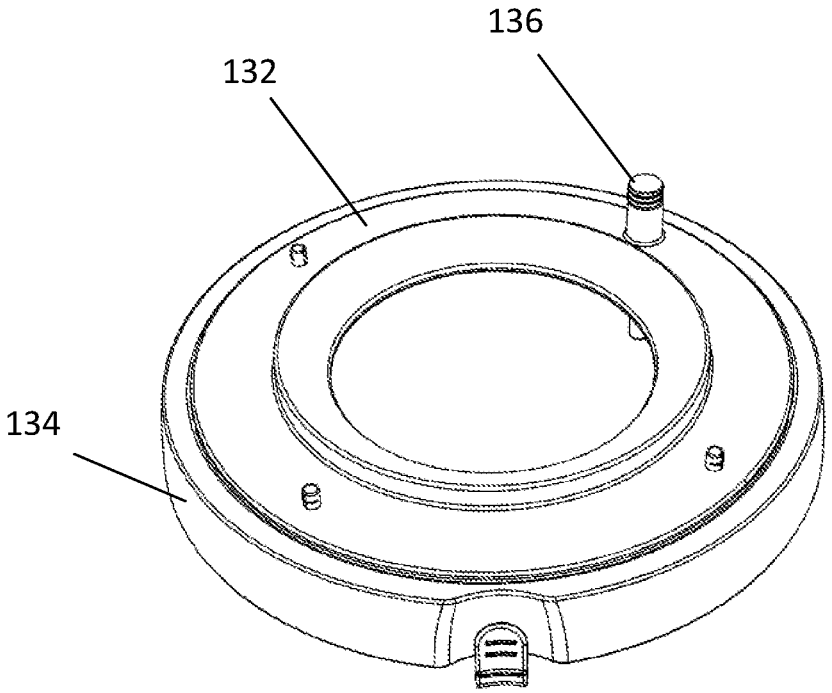
FIG. 9 is a perspective view of the frame assembly of FIG. 6 where the bag roller is in a second position.

FIGS. 7-9 illustrate an assembly of bag roller 132 and a bag base 134. When assembled, a user may attach the top rim of a disposable bag (not shown) to the bag roller 132 as described in U.S. Patent Application Publication Nos. US2016/0060026A1 and 2016/0060029A1, and then manually "prime" the disposable bag by grabbing the knob 136 to turn the bag roller 132 which in turn twists the top rim of the disposable bag against the body portion of the disposable bag. Once primed, the disposable bag's neck remains twisted shut until a user actively opens it by untwisting the neck of the bag. To untwist the neck of the disposable bag, a user can step on the foot pedal 174 to turn a rotating plate 172 which in turn rotates some kind of structure that is attached to the body of the disposable bag. When the body rotates in the appropriate direction, the neck of the bag is untwisted. The user can next dump waste such as cat litter down into the disposable bag.

Figure 10:
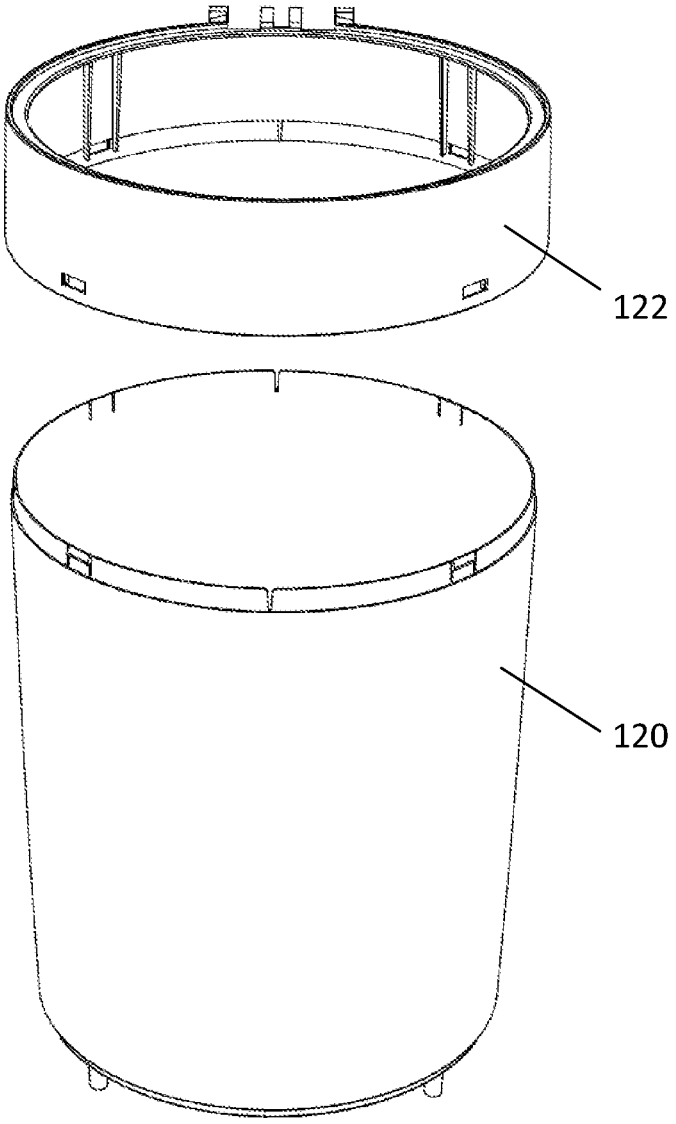
FIG. 10 is an exploded view of another embodiment of an outer casing showing an upper portion and a lower portion.
Figure 11:
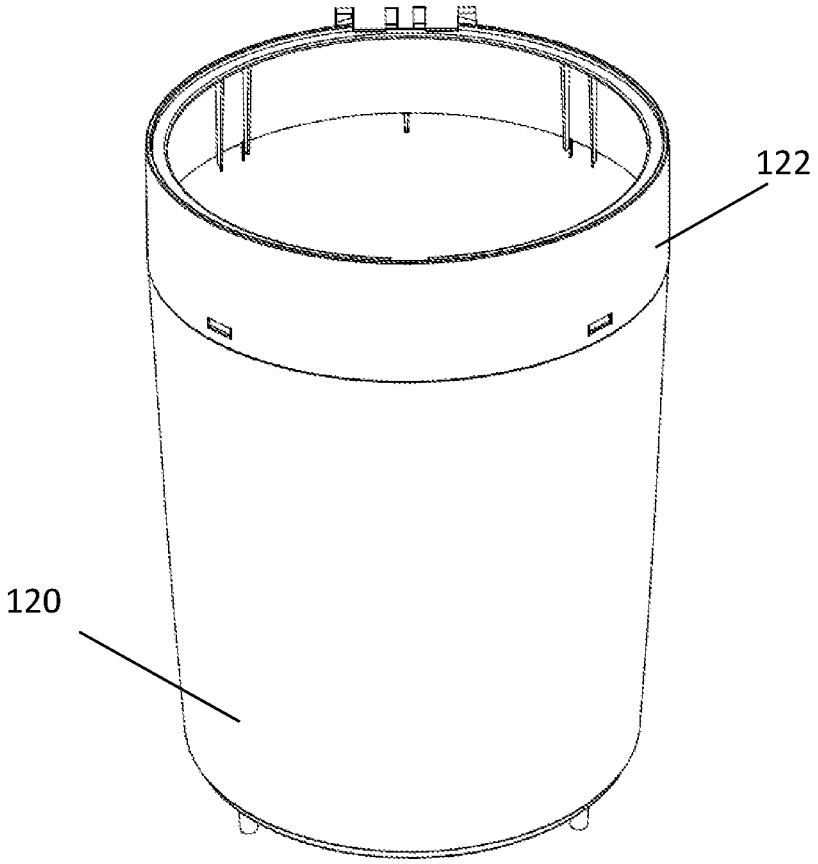
FIG. 11 is a perspective view of the outer casing of FIG. 10 in an assembled view, according to one aspect of the disclosed embodiments.

The assembly of bag roller 132 and bag base 134 can be pivotably attached to a bag roller body 122. The bag roller body 122 can be coupled to the top of the outer casing 120 (FIGS. 10 and 11).

Figure 12:
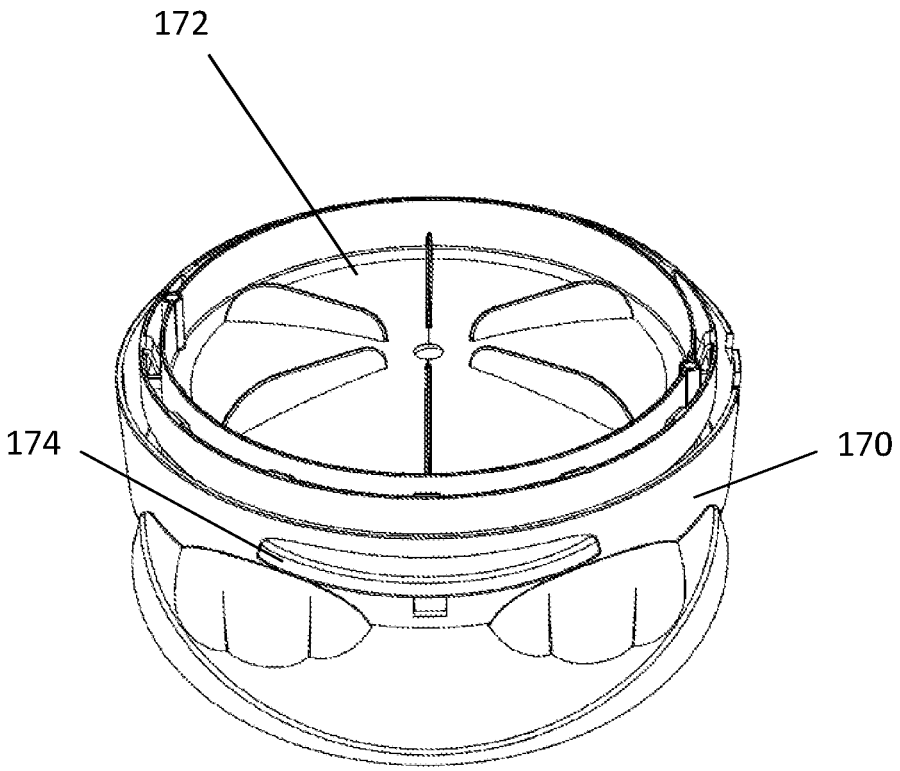
FIG. 12 is a perspective view of a base with a rotating plate on top of the base, according to one aspect of the disclosed embodiments.

Referring now to FIG. 12, a base 170 can have a foot pedal 174. Stepping on the food pedal 174 can in turn rotate the rotating plate 172. While the specific inner components and the mechanics of causing the rotating plate 172 to rotate using springs and levers are not described in detail herein, one of ordinary skilled in the art would immediately recognize some of the typical mechanism known to implement it. In one embodiment, the food pedal 174 may be replaced or supplemented by a motion sensor which activates a motor to turn the rotating plate 172.

From FIG. 13 through FIG. 34, various embodiments of a support will be described in detail.

Figure 13:
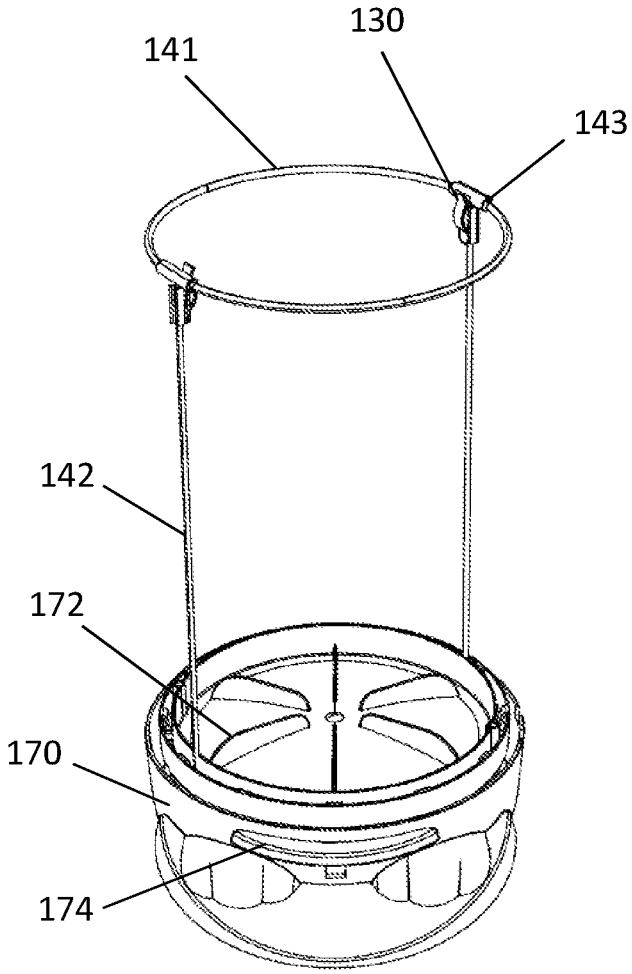
FIG. 13 is a perspective view of a base and a support using two tall vertical rods and a circular frame, according to one aspect of the disclosed embodiments.

In FIG. 13, this embodiment of support includes two rods 142 attached to a circular frame 141 via two connectors 143. When the rotating plate 172 rotates, the entire support also rotates along with it because the support is attached to the rotating plate 172. On each of the two connectors 143 is a catch 130. The catch 130 can be used to attach a certain part of the disposable bag to. By attaching the bag to the catch 130, the support can effectively rotate the body of the bag along with the support.

Figure 14:
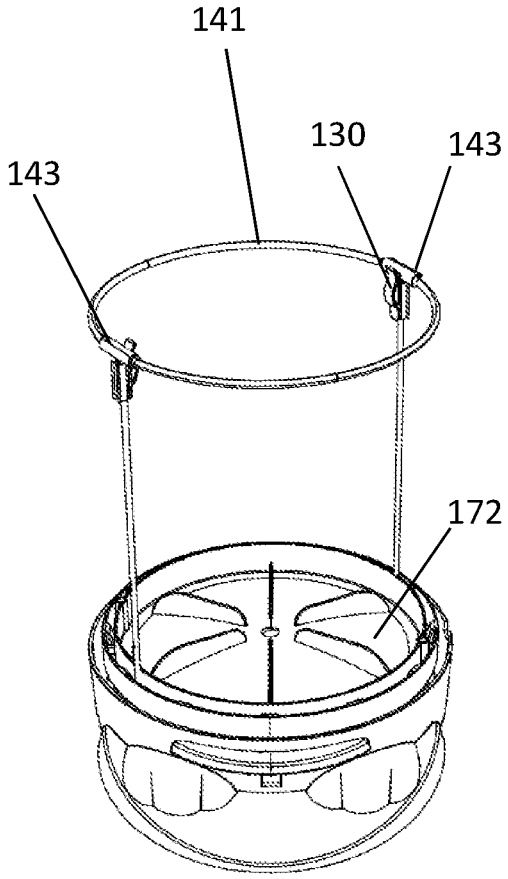
FIG. 14 is a perspective view of a base and a support using two short vertical rods and a circular frame, according to another aspect of the disclosed embodiments.

In the embodiment of FIG. 14, the support has similar components to the embodiment shown in FIG. 13 except that the rods 142 in FIG. 14 are shorter. A support having shorter rods 142 such as that shown in FIG. 14 can be used in a full height waste disposal container 100 like the one being used for the embodiment of FIG. 13. The shortened rods 142 allows a shorter catch 130 position which effectively increases the distance between the rim of the bag (at bag roller 132) and the area where the bag is attached to the support. This lowered position of the catch 130 can create a twisted neck in the bag that is substantially lower than the embodiment of FIG. 13. This is particularly contemplated when the waste disposal container is used to contain cat litter. When a scooper 182 or a shovel passes through the center aperture of the bag roller 132 to deposit cat litter into the bag, the scooper 182 or a shovel can touch the inside wall of the bag and soil the bag in some areas. If and when the twisted neck of the bag is at a higher position such as that shown in the embodiment of FIG. 13, the unsightly soiled portion of the bag would show when the neck is twisted shut. On the other hand, a lower twisted neck such as that offered by the embodiment of FIG. 14 would minimize the chance that a user would see the unsightly soiled portion of the bag when the neck is twisted shut. One contemplated method to have a lower twisted neck is to lower the position of the catch 130 in relation to the bag roller 132.

Preferably, the height of the catch 130 is between 40-90% of the height of the bag roller 132 from the base 170. Also preferably is where the height of the catch 130 is between 50-75% of the height of the bag roller 132 from the base 170. In yet another embodiment, the height of the catch 130 is between 40-65% of the height of the bag roller 132 from the base 170.

In other embodiments, the height of the catch 130 is not taller than 90% of the height of the bag roller 132 from the base 170. In yet another embodiment, the height of the catch 130 is not taller than 75% of the height of the bag roller 132 from the base 170. In still another embodiment, the height of the catch 130 is not taller than 60% of the height of the bag roller 132 from the base 170.

Figure 15:
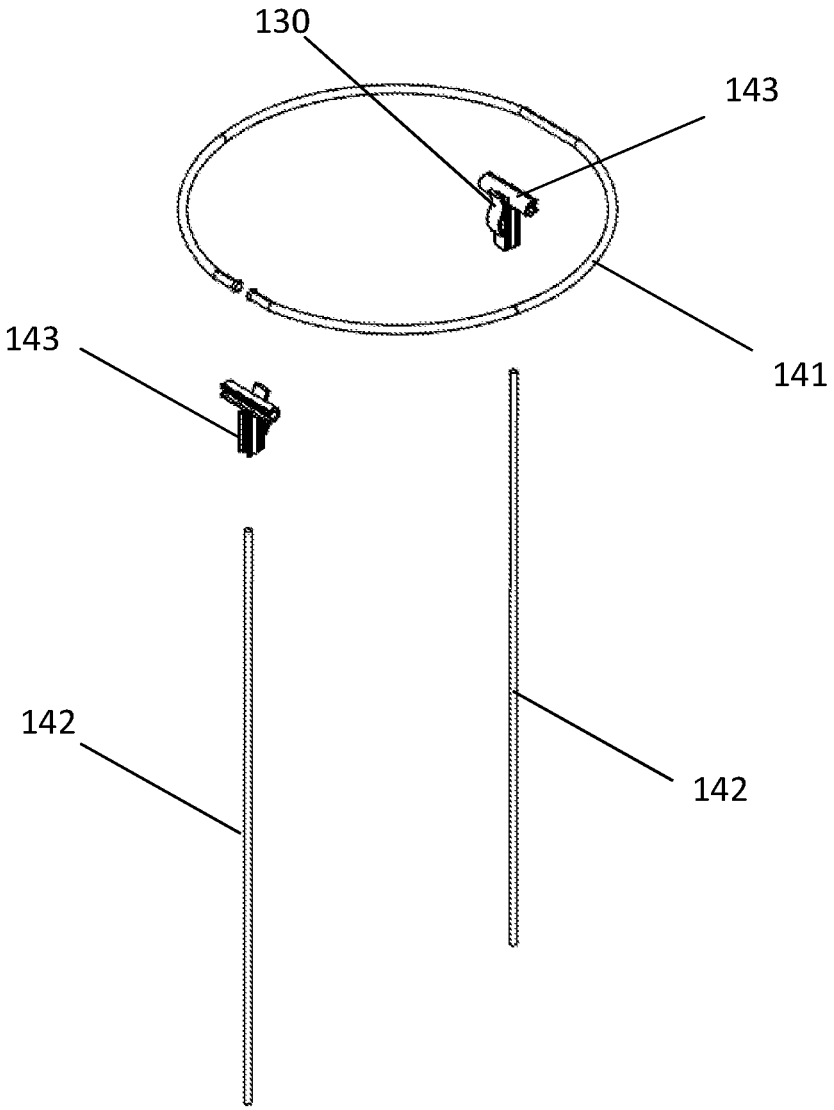
FIG. 15 is an exploded view of the support shown in FIG. 13, according to one aspect of the disclosed embodiments.

In FIG. 15, the support of FIG. 13 is disassembled. The connector 143 can have an open channel groove to receive the circular frame 141. Along the side of the connector 143 there can be another open channel groove to receive a rod 142. Many shapes and types of catch 130 are contemplated. Here, the catch 130 is shown as a clip. A disposable bag having some kind of tether or side aperture can simply latch on to this clip. Also, an ordinary disposable bag not having any kind of tether or side aperture can also work by, for example, simply folding a small section of the ordinary disposable bag and insert the folded section into the clip. As such, one of ordinary skill in the art would immediately recognize that there can be numerous other types of physical catch to accomplish the task of coupling to a side portion of a disposable bag.

Other types of physical catch contemplated may include a post, a cleat, a hook, a notch, a slit, an adhesive patch, a strap, and a hook-and-loop fastener.

Furthermore, although the catch 130 shown in most of the figures are shown to be located on the connector 143, it is also contemplated that the catch 130 may be located anywhere on the support. For example, the catch 130 may be on the circular frame 141 or on the rod 142.

Figure 16:
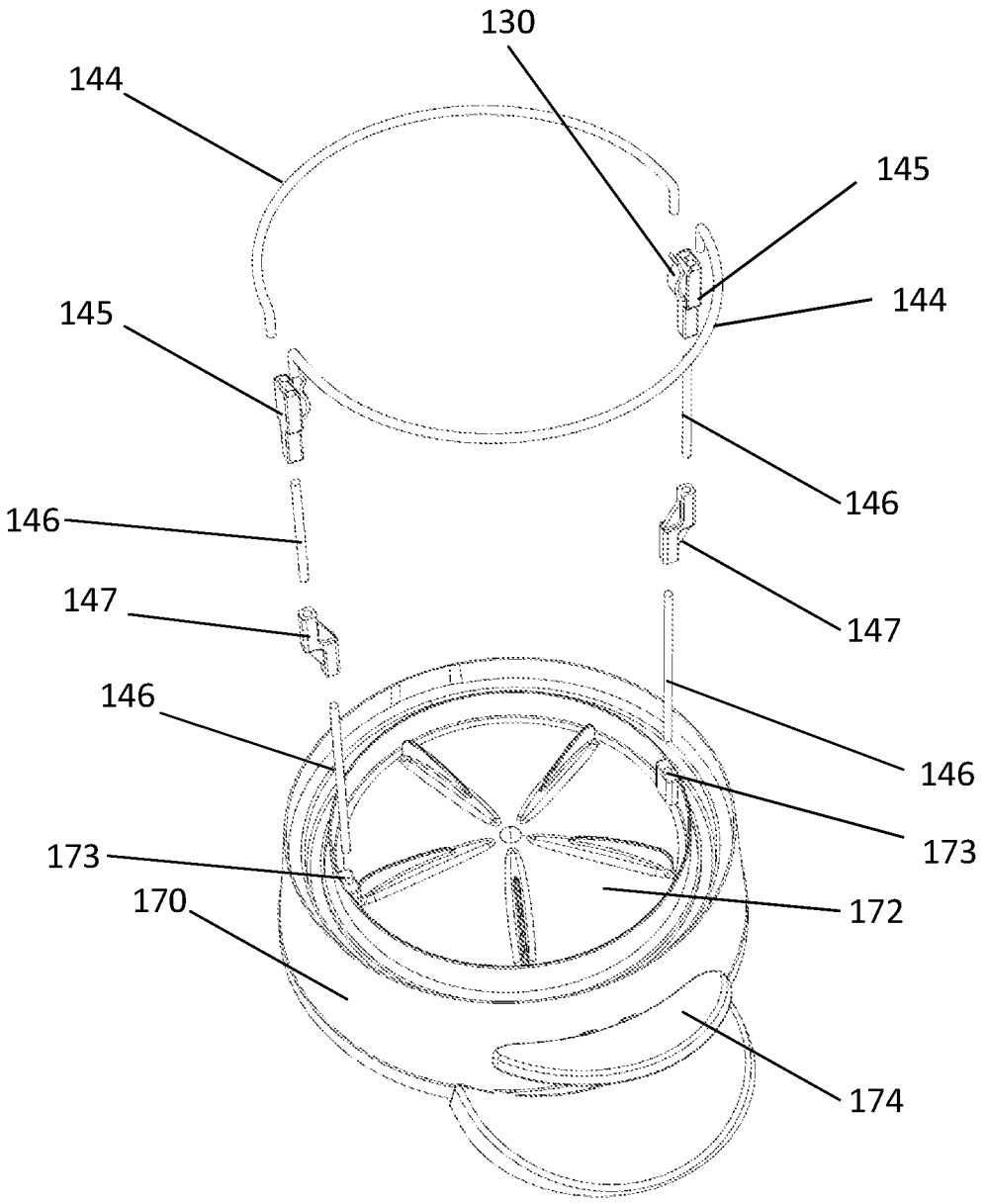
FIG. 16 is an exploded view of yet another embodiment of a support using two vertical rods that are collapsible, according to one aspect of the disclosed embodiments.

FIG. 16 is another embodiment of a support using a collapsible configuration. Here, one single long rod is replaced by two short rods 146 connected together by extender 147. The bottom short rod 146 is inserted into a receiver 173 of the rotating plate 172. A single circular frame is replaced by two half-circular frames 144. Connector 145 can have two top receiving holes where the terminal end of a half-circular frame 144 can insert into. The connector 145 can have a bottom hole into which the top short rod 146 can insert into. A catch 130 can be provided on one side of the connector 145.

Figure 17:
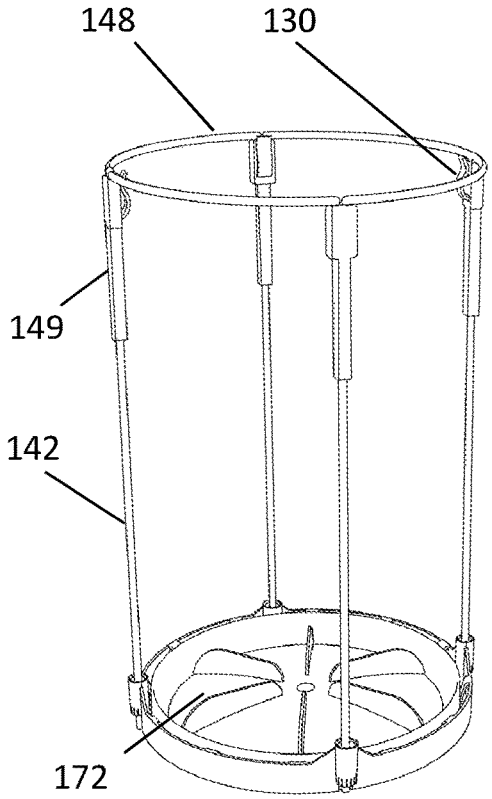
FIG. 17 is a perspective view of yet another embodiment of a support using four vertical rods and a circular frame made up of four separate quarter pieces, according to one aspect of the disclosed embodiments.
Figure 18:
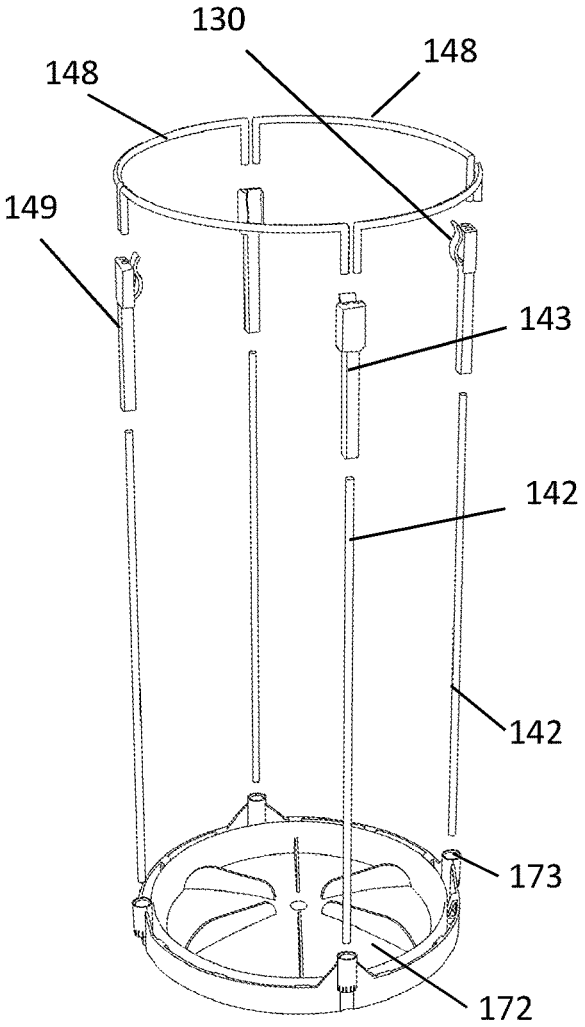
FIG. 18 is an exploded view of the embodiment shown in FIG. 17, according to one aspect of the disclosed embodiments.

FIG. 17 illustrates another embodiment where four long rods 142 are provided. FIG. 18 shows the embodiment of FIG. 17 in a disassembled view. The connectors 149 are substantially longer which can have a stronger structural integrity. The four long rods 142 are attached to the receivers 173 of the rotating plate 172.

In any of the embodiments shown in FIGS. 13-18, there can be a pliable liner 150 attached to the support. Examples are shown in FIGS. 19 and 20, showing a taller support and the shorter support, respectively.

One aspect of the pliable liner 150 can be to provide a barrier to keep the disposal bag and its content within a confined area. This is especially important when the content is heavy. For example, if a generous amount of cat litter is collected in the disposable bag, the support can keep the body portion within the confines of the support so that the bottom or the body of the bag does not spread out and touch the inside wall of the outer casing 120.

Another aspect of the pliable liner 150 is to essentially create an inner rotating barrier that rotates along with the rotating plate 172 without using a solid un-collapsible wall. By making the barrier collapsible, the waste disposal container 100 can be shipped in a substantially lower profile which can have a lower shipping cost.

The contemplated pliable liner 150 can be made of suitable materials which include natural and synthetic polymers, various metals and metal alloys, naturally occurring materials, textile fibers, and all reasonable combinations thereof. In one embodiment, the pliable liner 150 can be made of fabric. In one other embodiment, the pliable liner 150 can be made of a net. In still another embodiment, the pliable liner 150 can be made of a mesh. In one further embodiment, the pliable liner 150 can be made of a film.

As those of ordinary skill in the art will recognize, the concept of a collapsible rotating support can be readily be implemented in other ways. For example, there can be multiple short cylindrical walls (not shown) of decreasing diameters nested together. When these multiple short cylindrical walls are pulled apart vertically, they create a wall. These multiple short cylindrical walls can also collapse and fully or partially nest into each other to create a lower profile during shipping.

Figure 22:
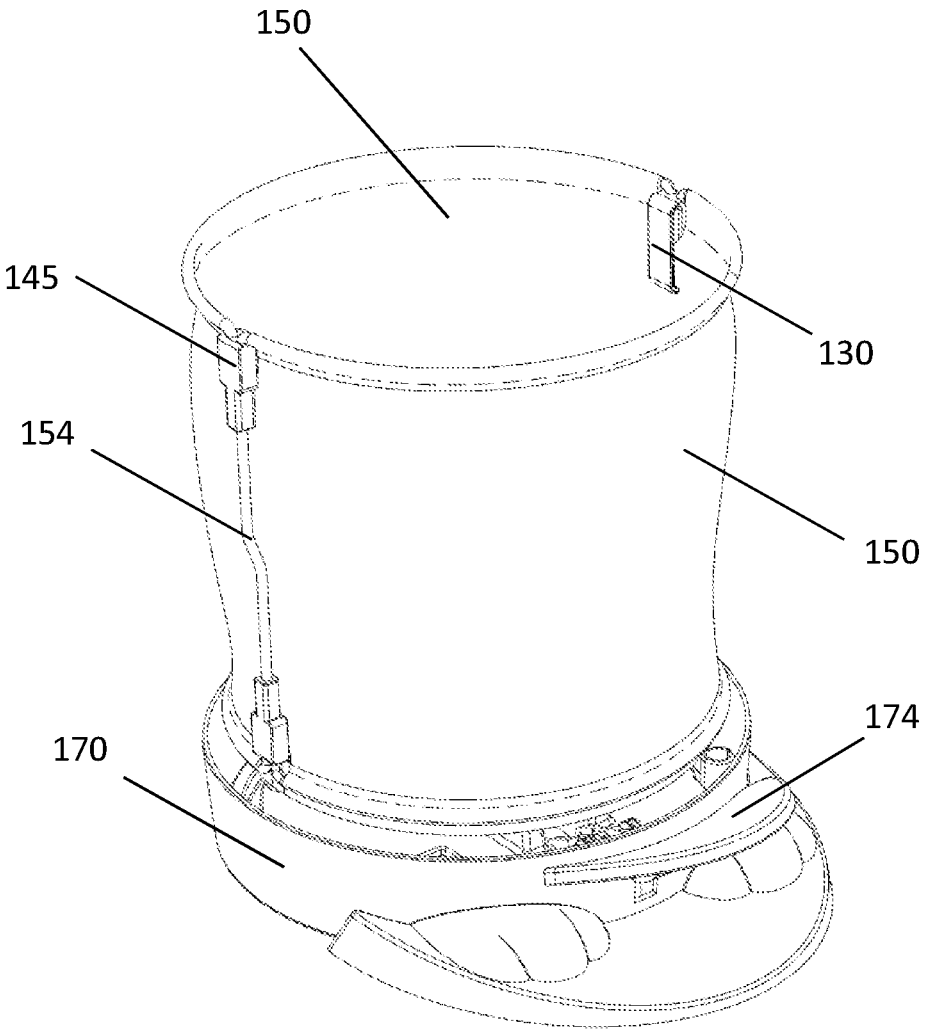
FIG. 22 is a perspective view showing the embodiment of FIG. 21, according to one aspect of the disclosed embodiments.

Similarly, FIG. 21 shows an embodiment of support in combination with a pliable liner 150. Particularly, this embodiment of support has a bottom circular frame 152. The two half-circular frames 144 hold the top part of the pliable liner 150, and the bottom circular frame 152 (also made of two half-circular frames) holds the bottom part of the pliable liner 150, stretching the pliable liner 150 tight. FIG. 22 shows another view of the same embodiment of FIG. 21. Each of the two rods 154 can have a curve in its mid-section so that the upper portion of the support has a larger diameter than its lower portion.

Figure 23:
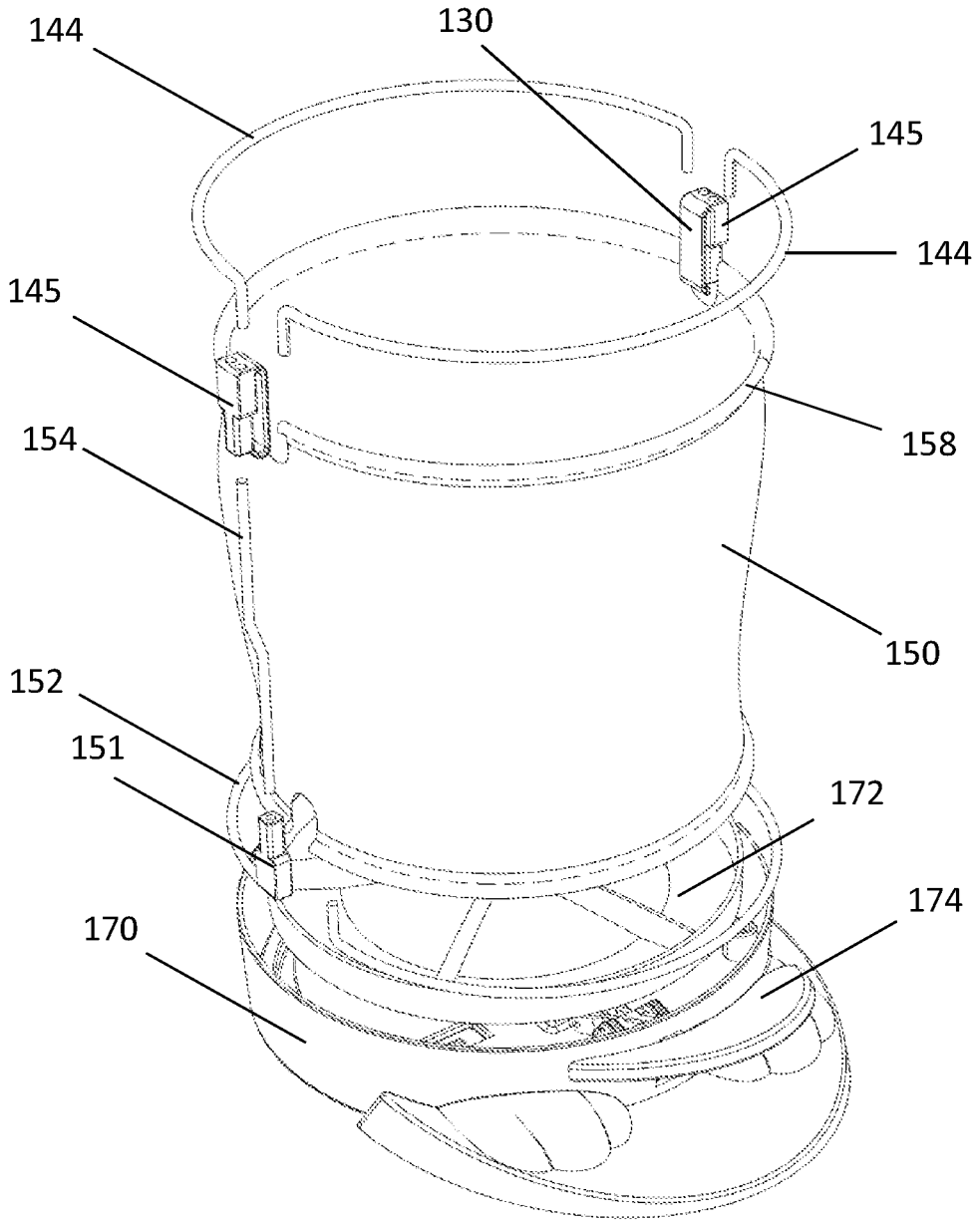
FIG. 23 is an exploded view showing the embodiment of FIG. 21, according to one aspect of the disclosed embodiments.

FIG. 23 shows the embodiment of FIG. 22 disassembled. The bottom circular frame 152 can clip onto some kind of receiving clips on the rotating plate 172.

Figure 24:
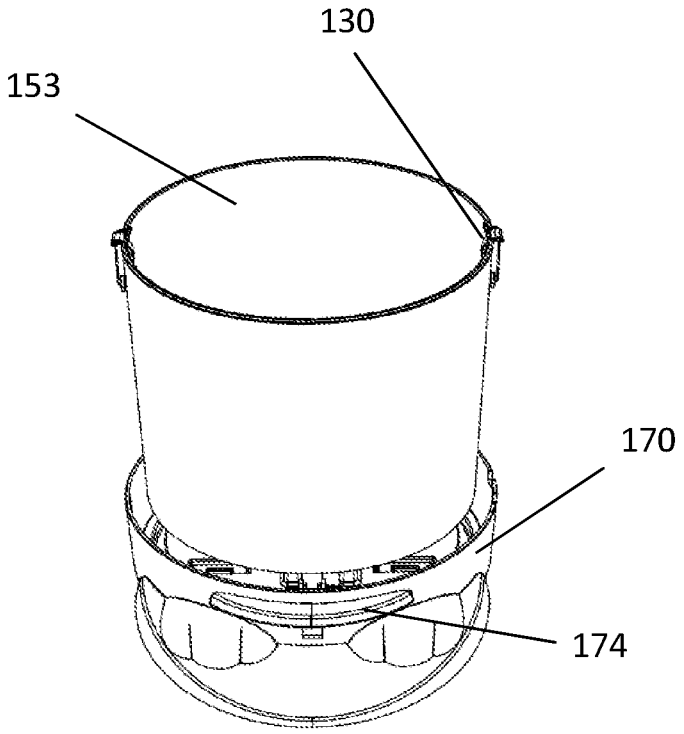
FIG. 24 is a perspective view showing still another embodiment of a support using a short barrel-like wall, according to one aspect of the disclosed embodiments.

FIG. 24 shows one embodiment where instead of using a pliable liner propped up by a support framework, a short solid wall 153 is used. The height of this wall is similar to that shown in the embodiments of FIGS. 14 and 20 to serve the same purpose of creating a much lower twisted neck in the disposable bag. There can be at least two catches 130 located on the inside of the short wall 153. Preferably, the height of the catch 130 is between 40-90% of the height of the bag roller 132 from the base 170. Also preferably is where the height of the catch 130 being between 50-75% of the height of the bag roller 132 from the base 170. In yet another embodiment, the height of the catch 130 is between 40-65% of the height of the bag roller 132 from the base 170.

Figure 25:
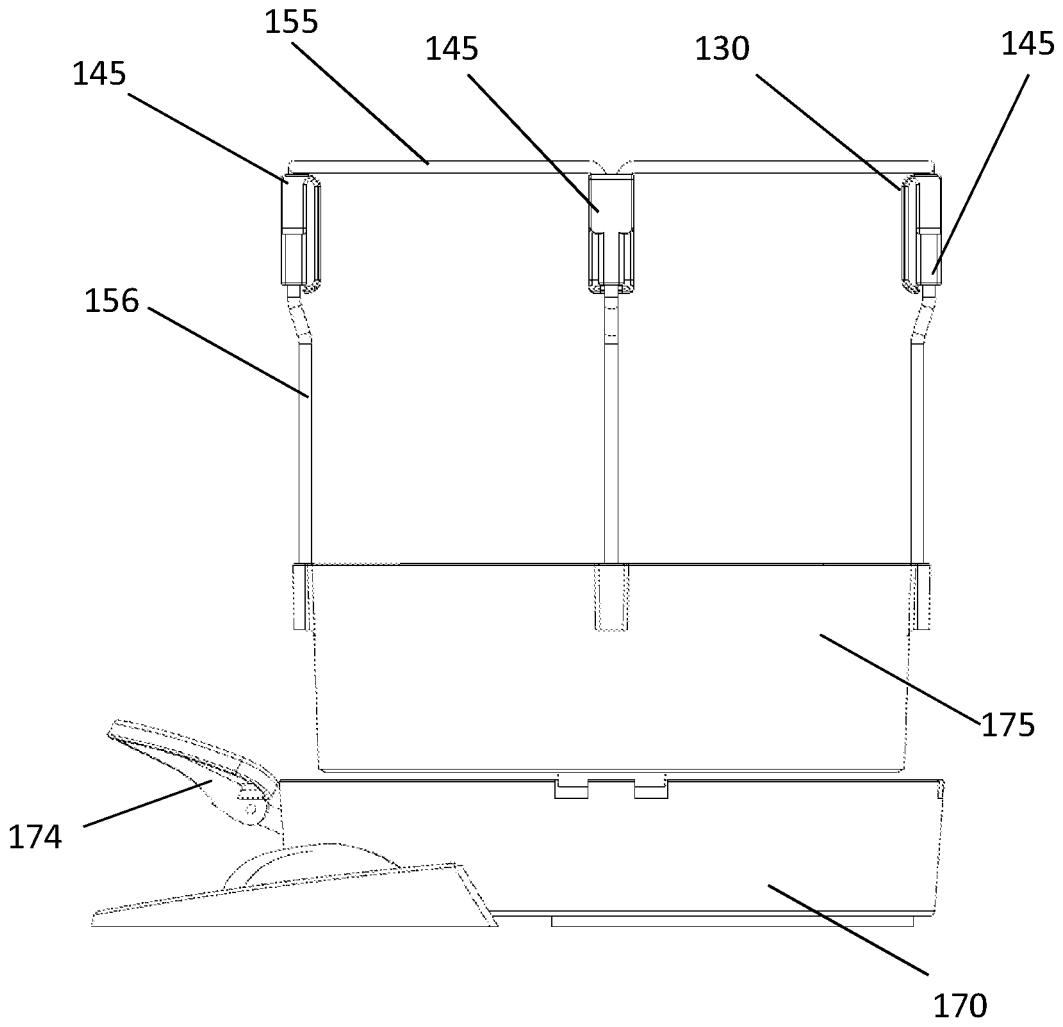
FIG. 25 is a side view of yet another embodiment of a support using a combination of four vertical rods, a circular frame, and a short barrel-like wall, according to one aspect of the disclosed embodiments.

Although the above embodiments disclose using a wall or a pliable liner separable from the rotating plate 172, FIG. 25 illustrates an alternative design to achieve the same purpose of providing proper containment of the disposable bag and its contents. In FIG. 25, the rotating plate 172 itself has a raised edge forming a raised wall 174. On the raised wall 174 there can be receivers to receive rods 156. In this embodiment, there are no pliable liners. Although the raised wall 174 does not cover the entire height of the support. The raised wall 174 is sufficient to keep the bottom of the disposable bag from spreading outward.

Figure 26:
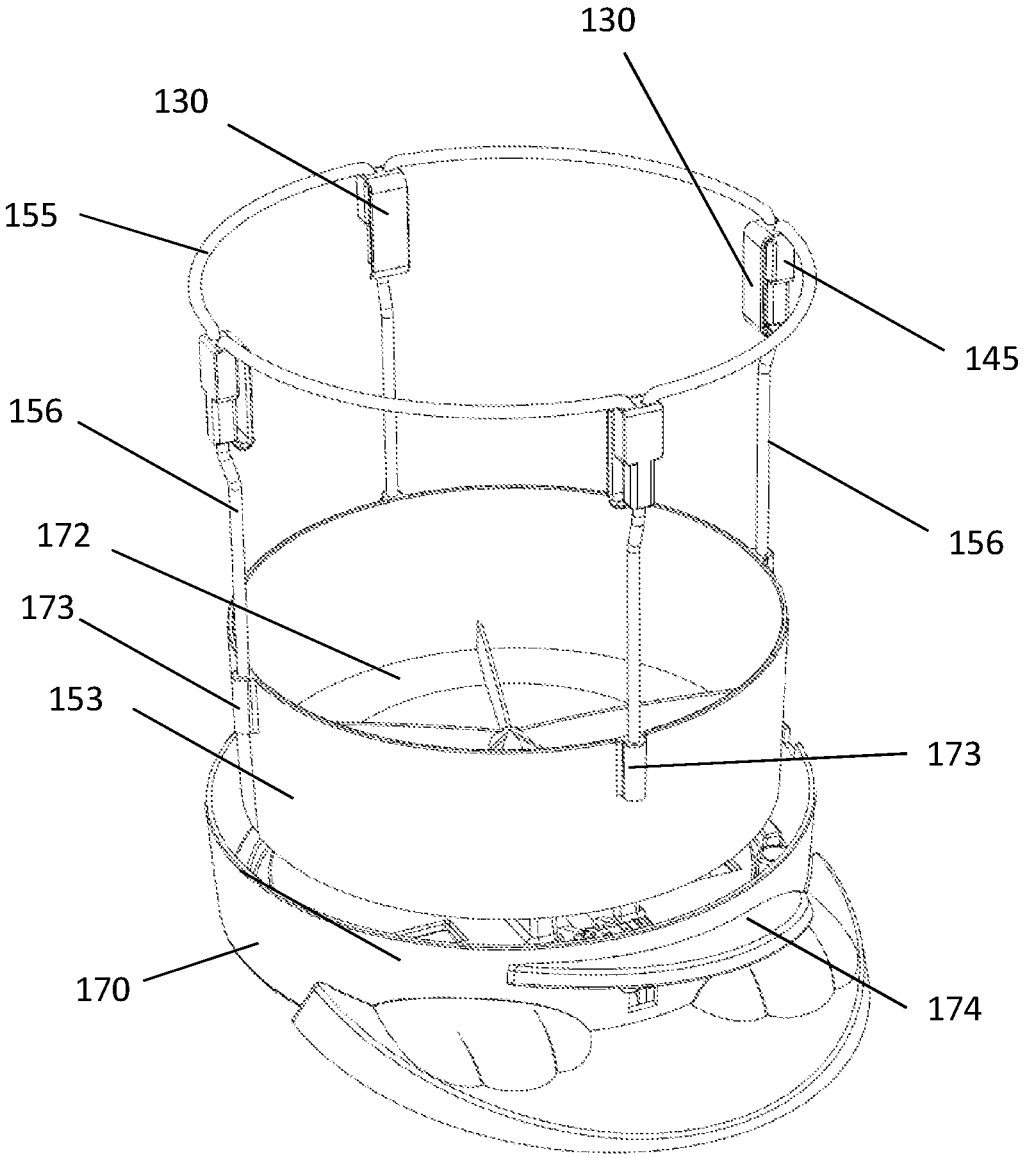
FIG. 26 is a perspective view of the embodiment of FIG. 25, according to one aspect of the disclosed embodiments.
Figure 27:
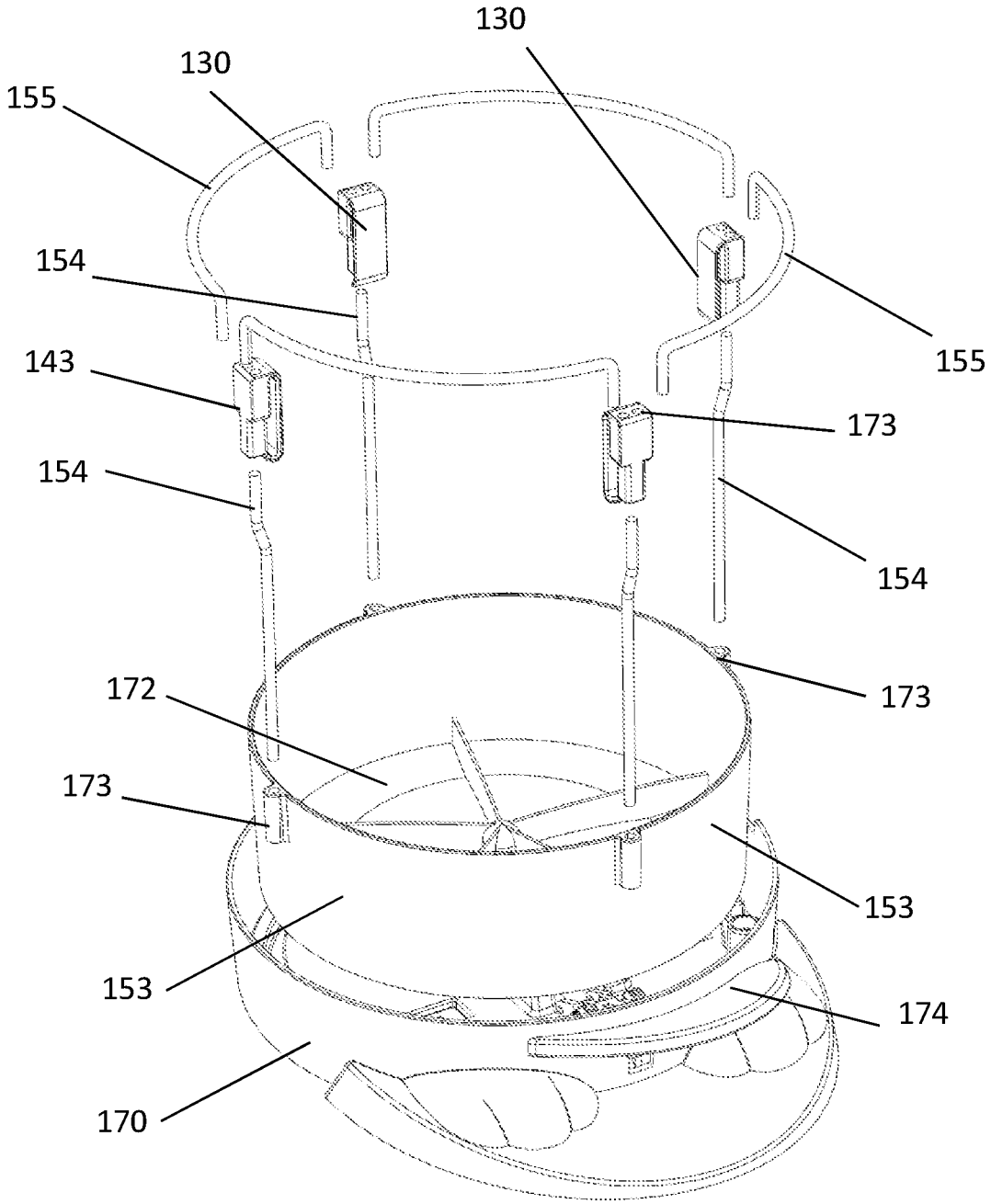
FIG. 27 is an exploded view of the embodiment of FIG. 25, according to one aspect of the disclosed embodiments.

FIGS. 26 and 27 illustrate the embodiment of FIG. 25 in more detail. When a user step on the foot pedal 174, the rotating plate 172 having the raised wall 174 rotates. The support (comprised of rods 156, connectors 145, circular frames 155, catches 130) turns together with the raised wall 174 to which it is coupled to. When these components rotate, the outer casing 120, the bag roller 132, the bag base 134, and the top lid 110 remain stationary and unaffected.

Figure 28:
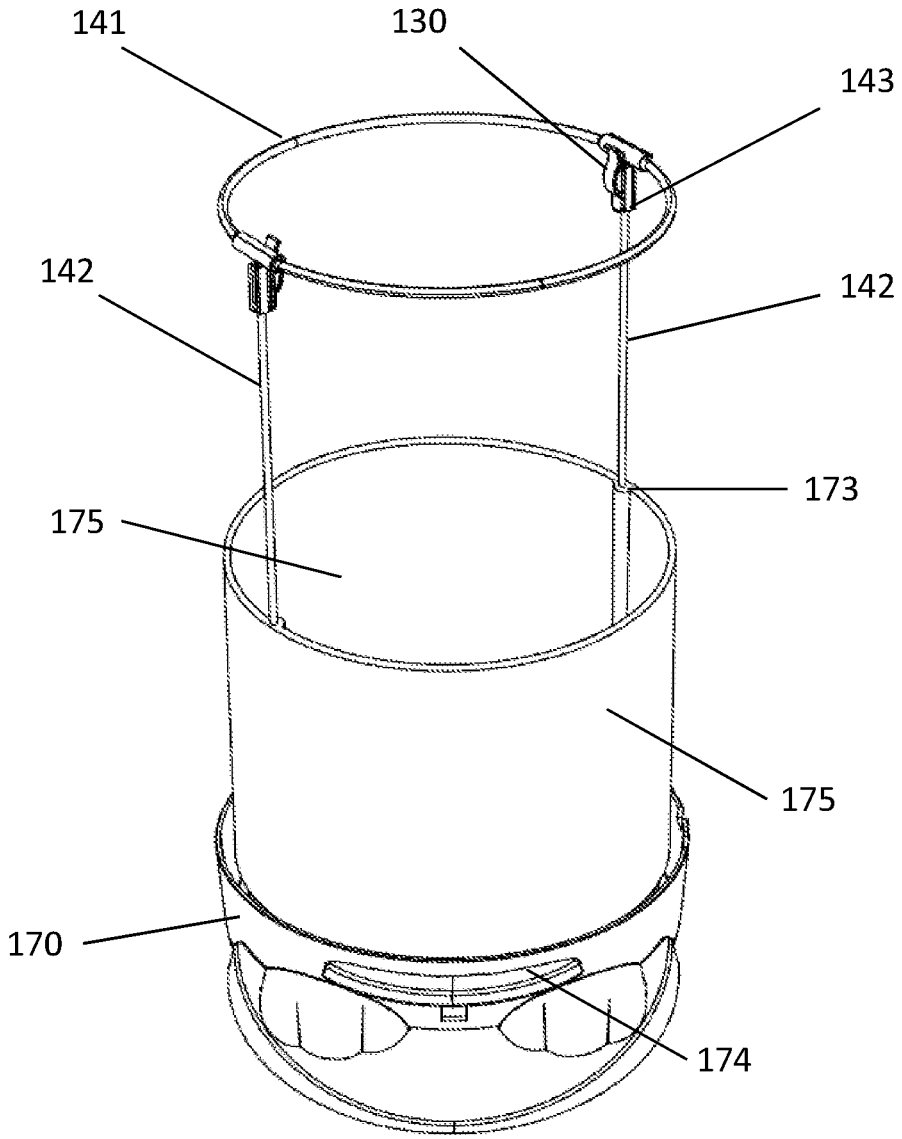
FIG. 28 is a perspective view of yet another embodiment of a support similar to that shown in FIG. 25 in that the support is comprised of a short barrel-like wall and a skeleton above the wall, according to one aspect of the disclosed embodiments.

FIG. 28 is an embodiment similar to that shown in FIGS. 25-27 in that it also implements a short wall 174 to which a support framework (comprised of rods 142, connectors 143, catches 130, and circular frame 141) are coupled to.

Figure 29:
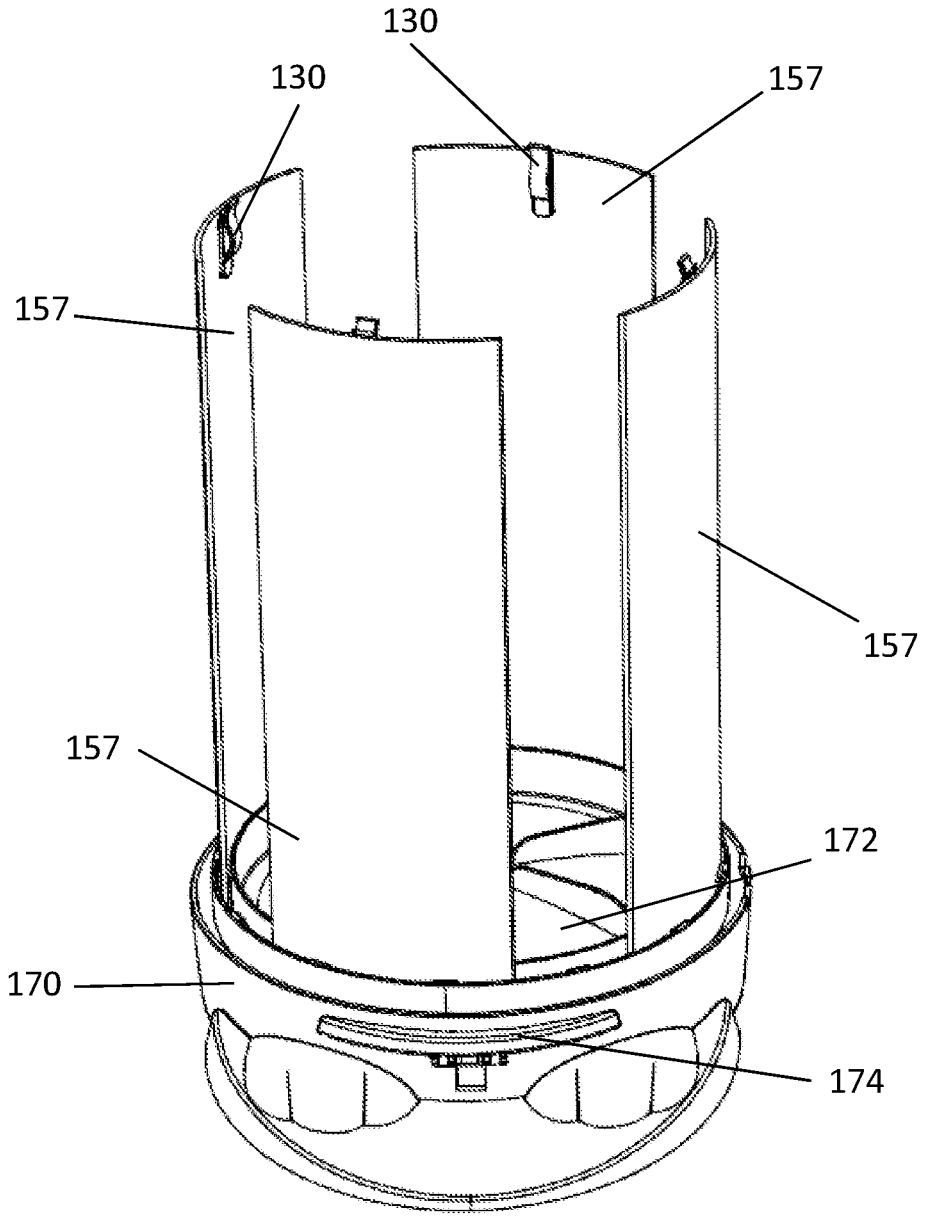
FIG. 29 is a perspective view of still yet another embodiment of a support using vertically raised plates, according to one aspect of the disclosed embodiments.

FIG. 29 shows a different type of support where no rods and no circular rings are provided. Here, vertically raised plates 157 attached to the rotating plate 172. There can be any numbers of vertically raised plates 157, and the distance between them can vary. In the embodiment shown, there are four such vertically raised plates 157. Each of these vertically raised plates can have a catch 130 placed anywhere on the inside wall of the vertically raised plates. It is specifically contemplated that the catch can be located at any height even though they are shown in FIG. 29 to be located on the upper most edge of the vertically raised plates 157. These vertically raised plates 157 turn together with the rotating plate 174 to which they are coupled to. When these components rotate, the outer casing 120, the bag roller 132, the bag base 134, and the top lid 110 remain stationary and unaffected.

Figure 30:
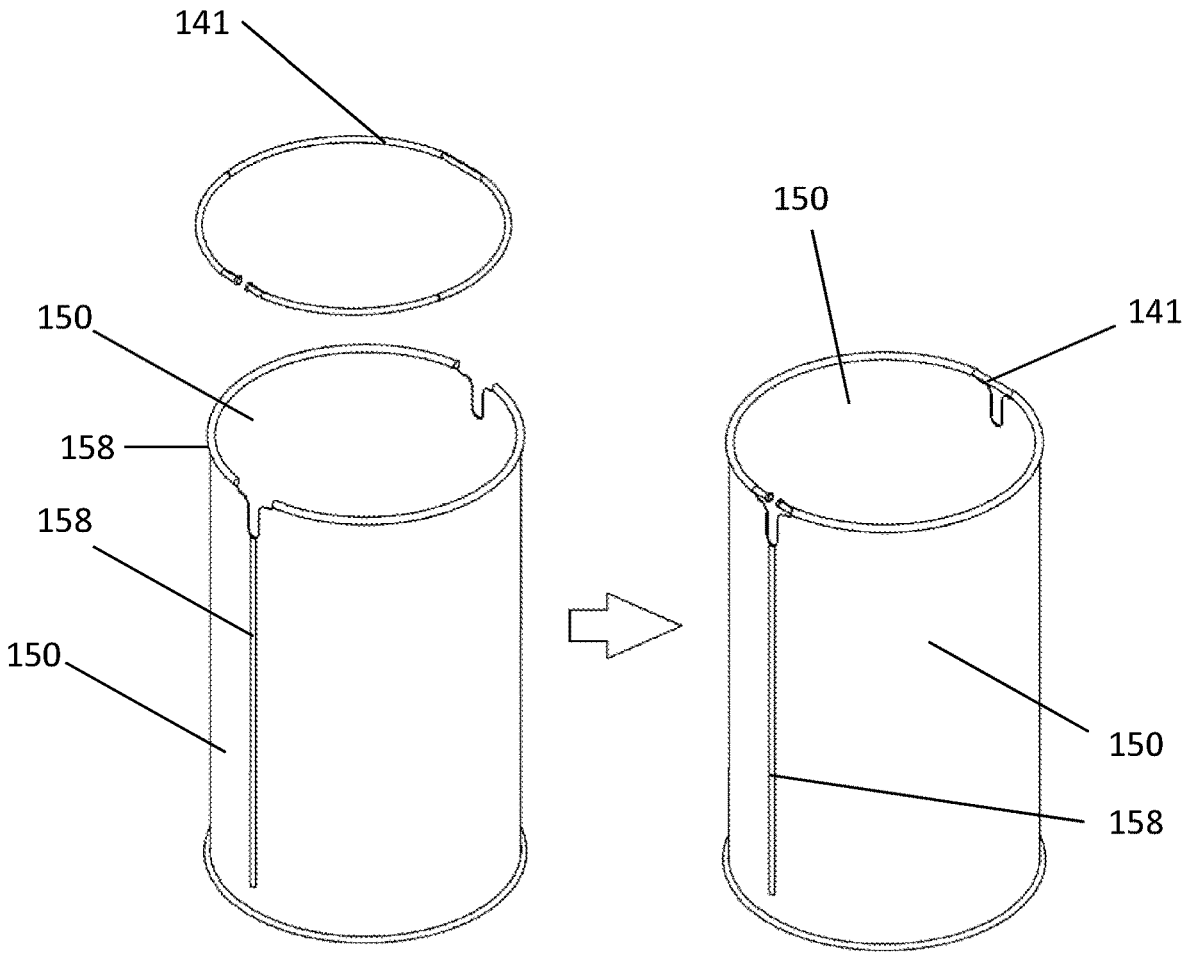
FIG. 30 illustrates the assembling of the embodiment of support as shown in FIG. 19, according to one aspect of the disclosed embodiments.

FIGS. 30-34 reveal the step-by-step process of assembling the embodiment shown in FIG. 19. Referring first to FIG. 30, a circular frame 141 is prepared to be inserted into a top tunnel 158 of the pliable liner 150. The tunnel 158 can be a portion of the pliable liner 150 folded in to create a channel to serve the purpose of keeping the circular frame 141 in place. Alternatively, loops similar to belt loops on a pair of pants may be used to serve the same purpose. The plier liner 150 also has a pair of vertical tunnels 158 running down the sides of the plier liner 150. The purpose of these vertical tunnels 158 will be discussed later. On the right side of the FIG. 30 shows a plier liner 150 with circular frame 141 already inserted into the tunnel 150.

Figure 31:
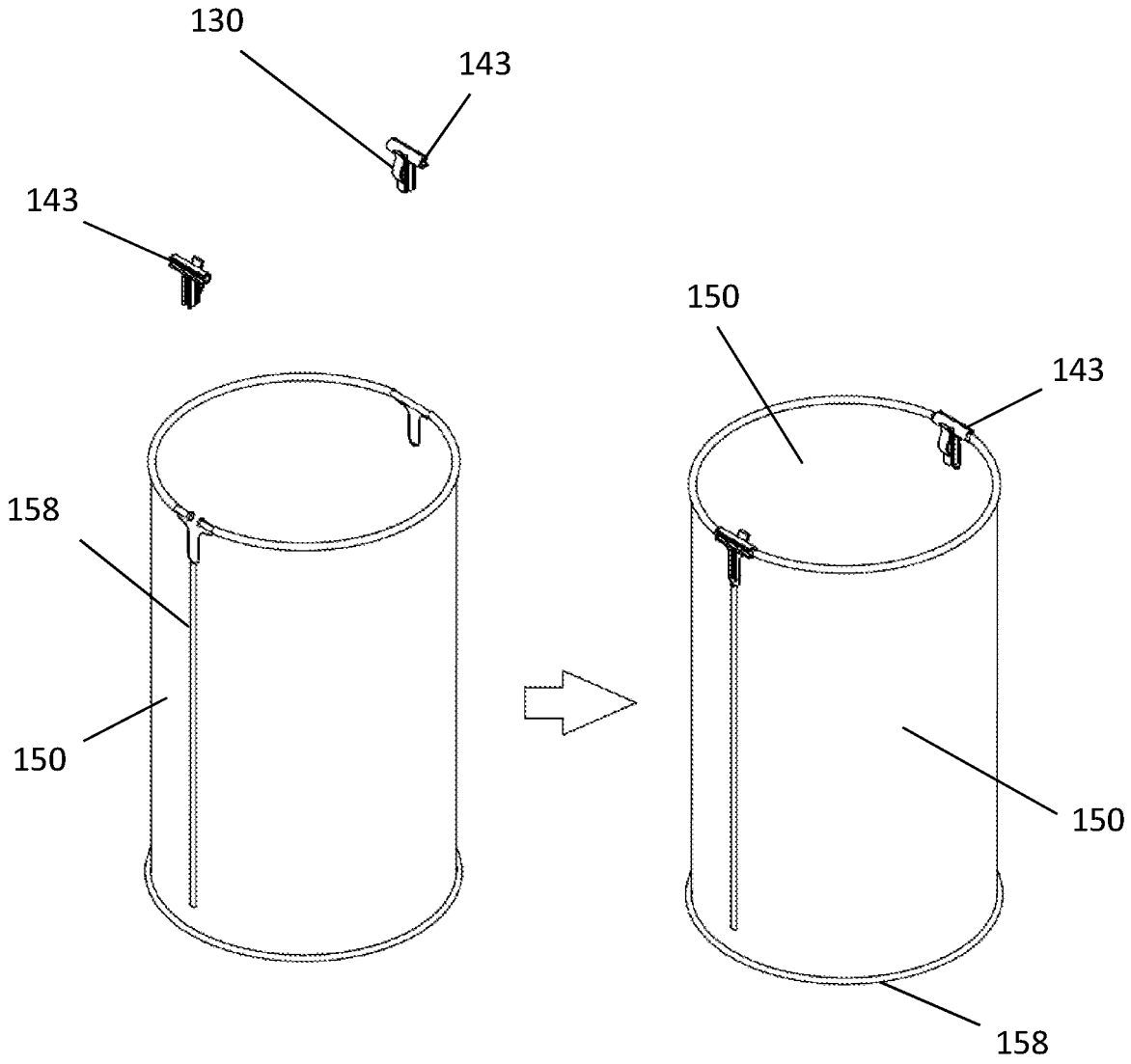
FIG. 31 continues the assembling from FIG. 30, according to one aspect of the disclosed embodiments.

Next, the installation of connectors 143 is shown in FIG. 31.

Figure 32:
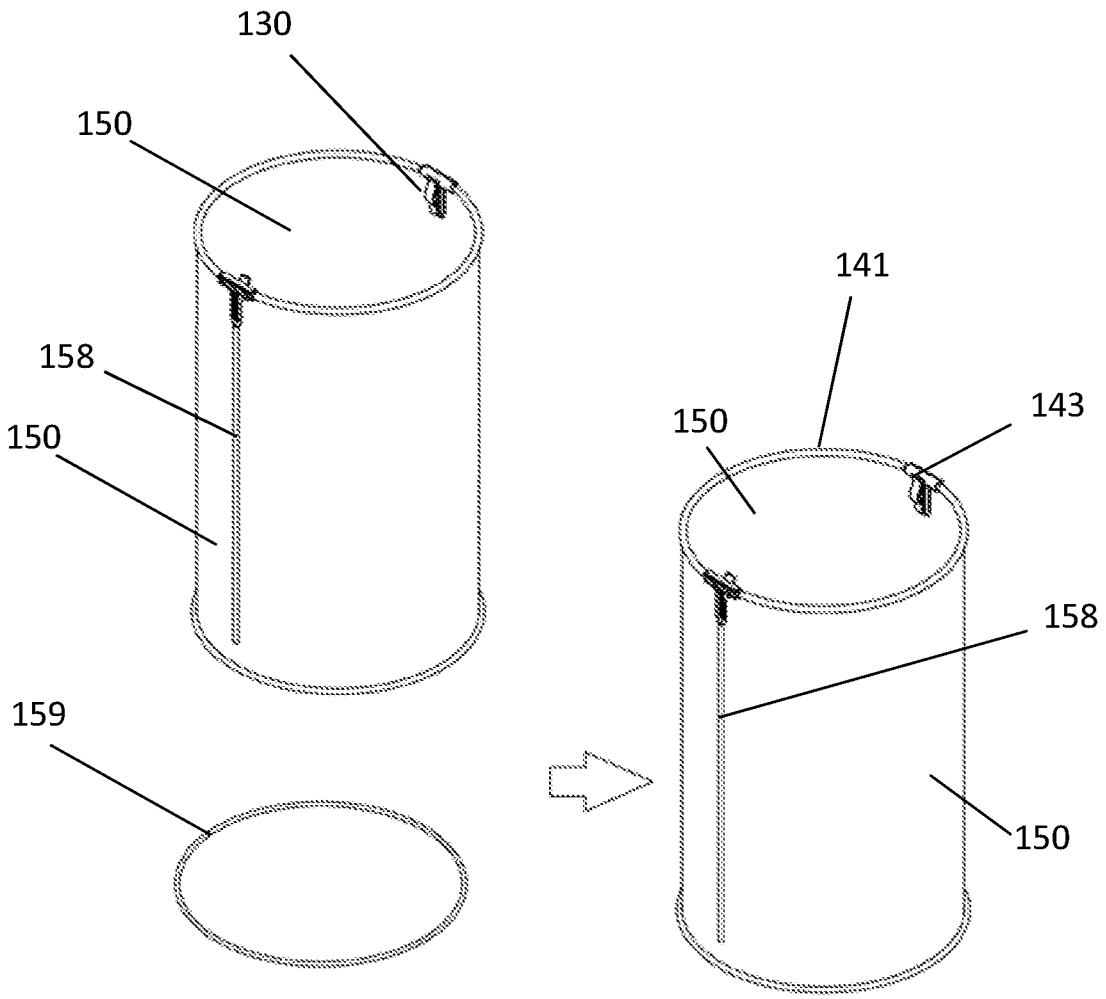
FIG. 32 continues the assembling from FIG. 31, here, a bottom circular frame is attached to the bottom of the pliable liner, according to one aspect of the disclosed embodiments.

In FIG. 32, a bottom ring 159 is attached to the bottom rim of the pliable liner 150. The attachment can be made possible by using similar tunnels or loops.

Figure 33:
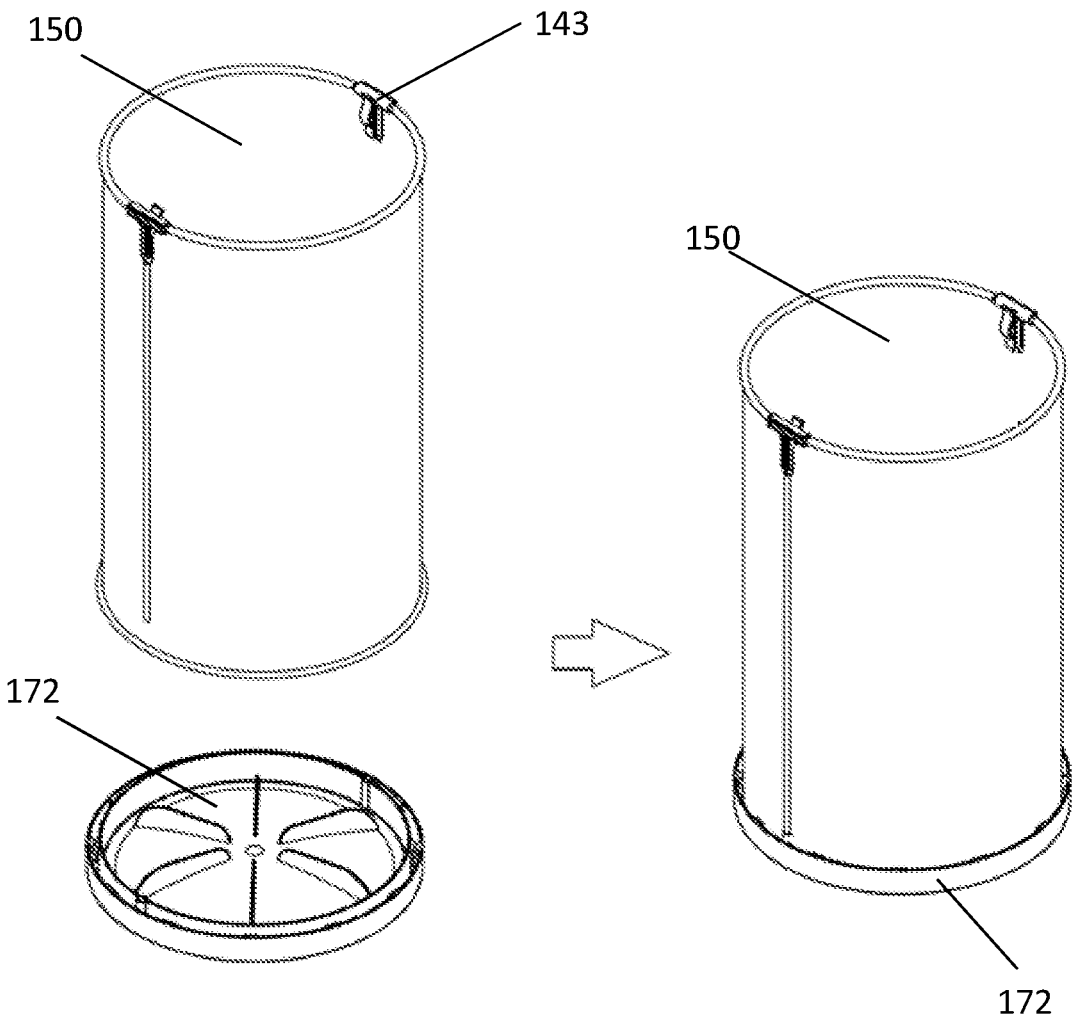
FIG. 33 continues the assembling from FIG. 32. Here, the support is attached to the rotating plate, according to one aspect of the disclosed embodiments.

Referring now to FIG. 33, the bottom of the pliable liner 150 having the rigid bottom ring 159 installed is now attached to the rotating plate 172 using a receiving structure such as a clip to hold the bottom ring 159 to the rotating plate 172.

It should be noted that for ease of illustration, the pliable liner 150 are shown in FIGS. 30-33 to hold an upright shape. In reality, the pliable liner 150 may be too soft and pliable to hold an upright shape on its own without having rods 142 inserted.

Figure 34:
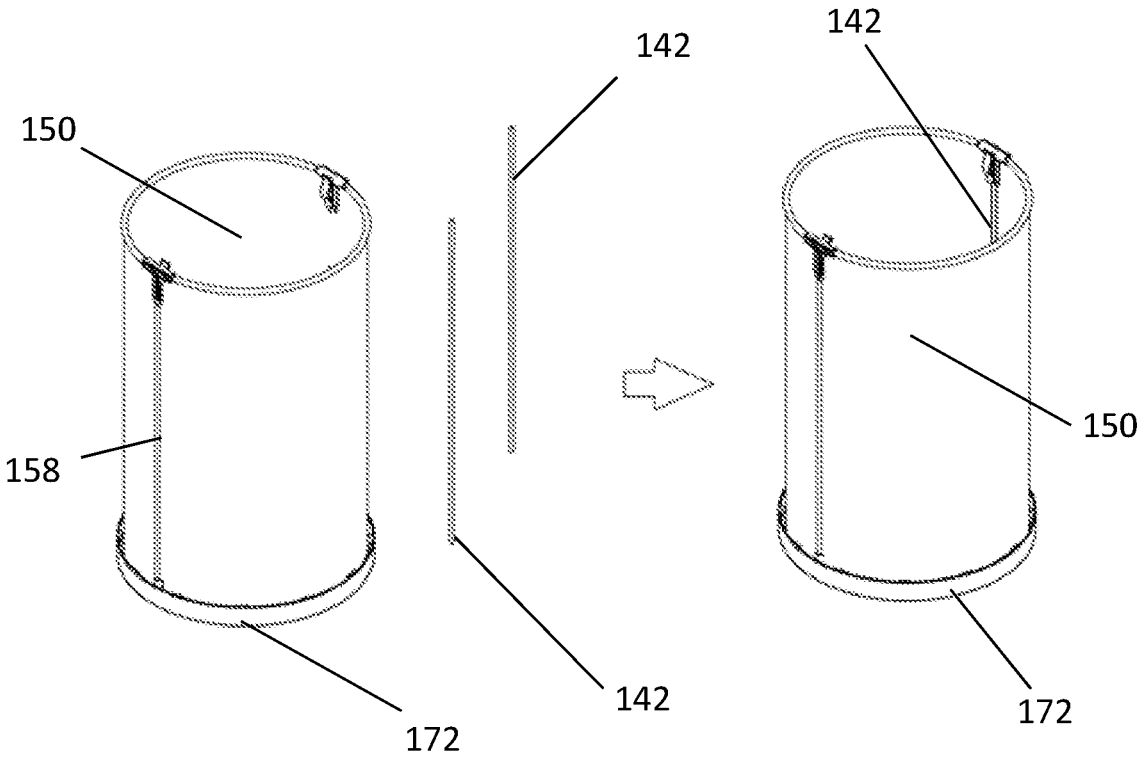
FIG. 34 continues the assembling from FIG. 33, here, the vertical rods are inserted into the pliable liner and are attached to the top circular frame and to the rotating plate, according to one aspect of the disclosed embodiments.
Figure 35:
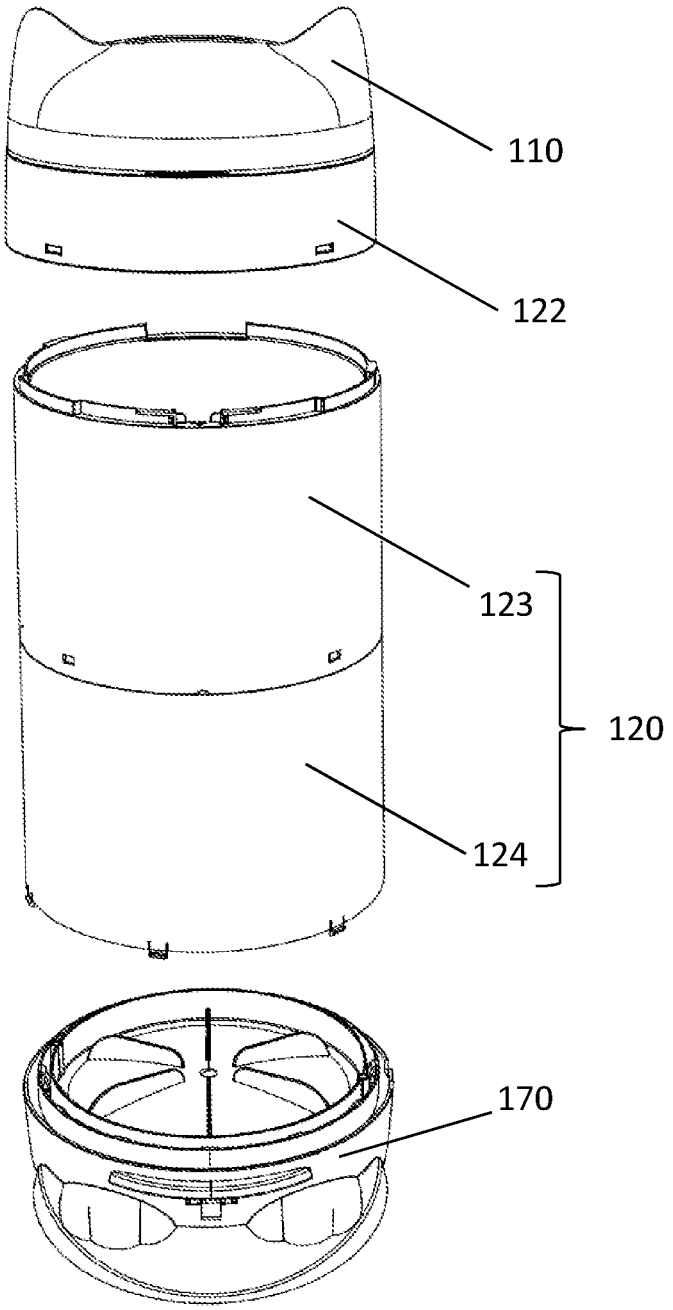
FIG. 35 is a perspective view of a disassembled waste disposal container, according to one aspect of the disclosed embodiments.

Insertion of rods 142 are shown in FIG. 34. Rods 142 are inserted through vertical channels 158. The top terminal end of each rod 142 is inserted into a receiving hole of the connector 143 and the bottom terminal end of each rod 142 is inserted into a receiving hole of the rotating plate 172.

FIGS. 35-39 illustrate a method of reducing the shipping profile of a waste disposal container 100. Essentially, the outer casing 120 of a waste disposal container can have two separable pieces: an upper portion 123 and a lower portion 124. The upper portion 123 and the lower portion 124 are sized and shaped such that when disassembled, the upper portion 123 may insert through the bottom opening of the bottom lower portion 124, nesting the two together so that the top portion 123 is entirely or at least partially enclosed within the lower portion 124.

Figure 36:
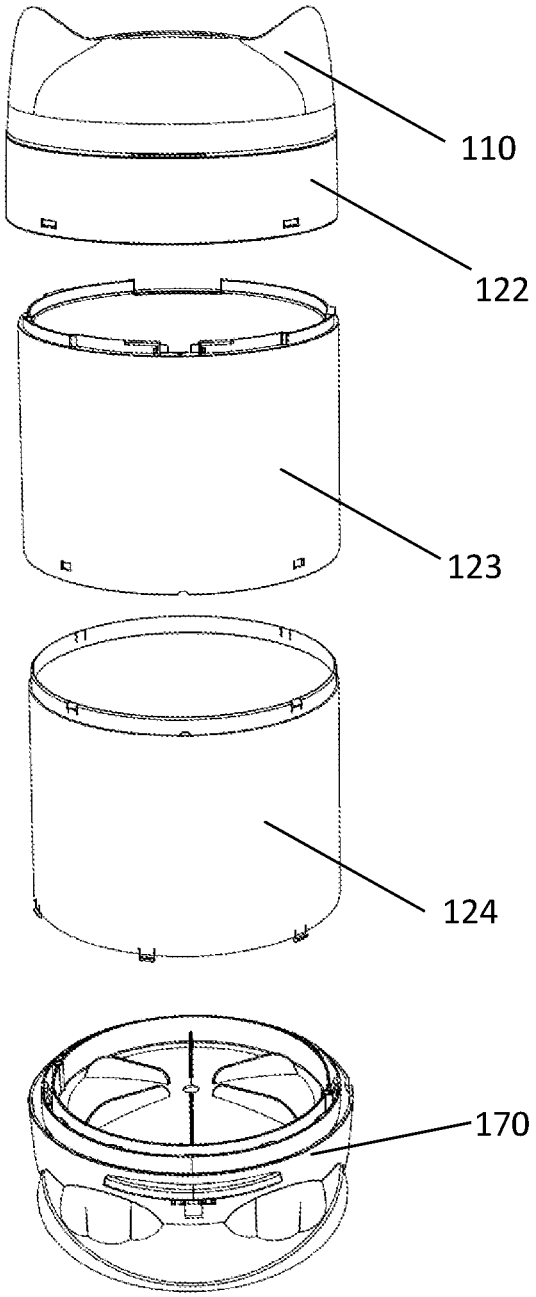
FIG. 36 is a perspective view of a further disassembled waste disposal container from FIG. 35, according to one aspect of the disclosed embodiments.

FIG. 36 shows the top portion 123 and the lower portion 124 being separated from each other.

Figure 37:
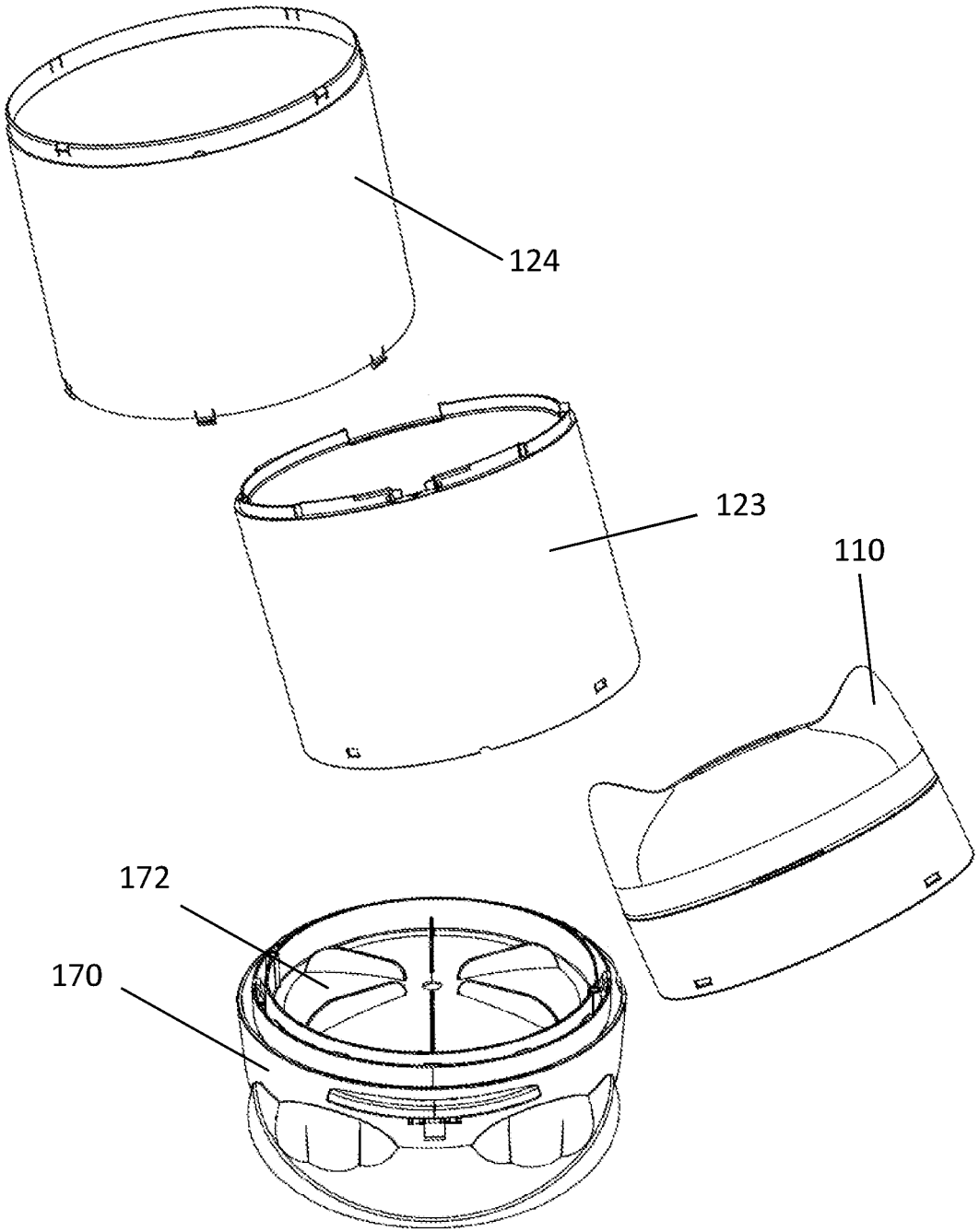
FIG. 37 is a perspective view of the disassembled waste disposal container from FIG. 36, according to one aspect of the disclosed embodiments.

In a further contemplated embodiment and method, even the top lid 110/bag roller body 122 assembly is sized and shaped to fit entirely or at least partially within the upper portion 123. In FIG. 37, the top lid 110/bag roller body 122 assembly is about to insert through the bottom opening of the upper portion 123 which is about to insert through the bottom opening of the lower portion 124.

Figure 38:
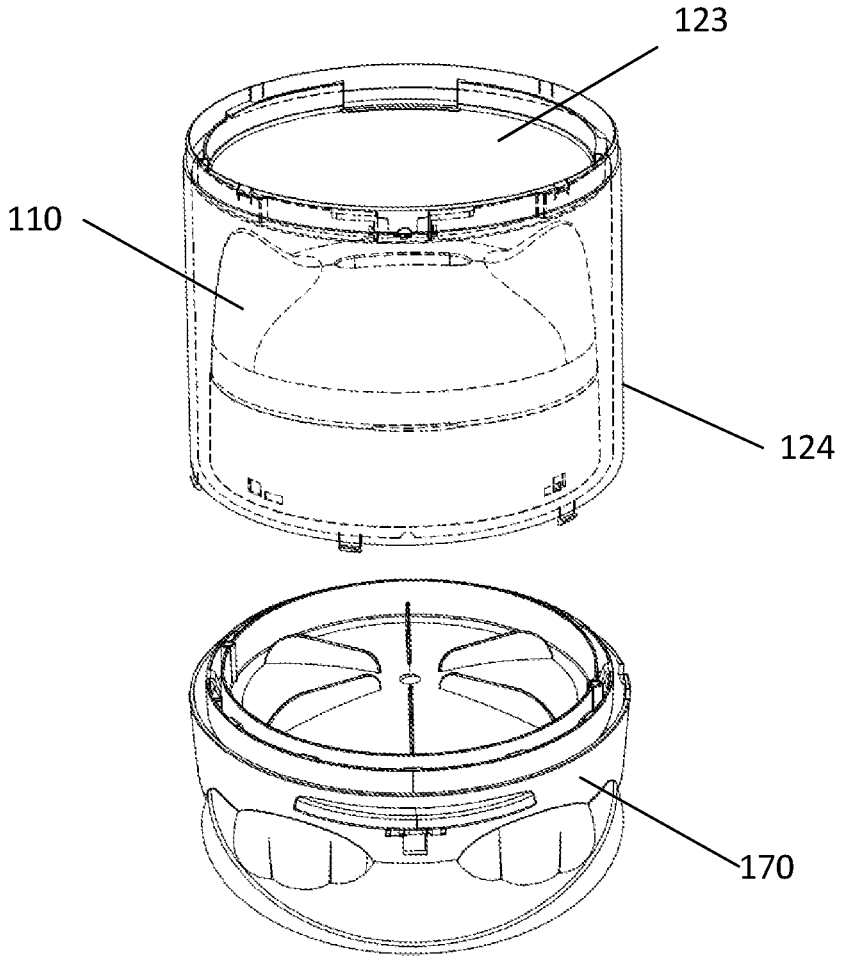
FIG. 38 illustrates nesting of parts from the disassembled waste disposal container of FIG. 37, according to one aspect of the disclosed embodiments.

FIG. 38 shows a contemplated embodiment where the top lid 110/bag roller body 122 assembly is entirely enclosed within the upper portion 123 which is entirely enclosed within the lower portion 124.

Figure 39:
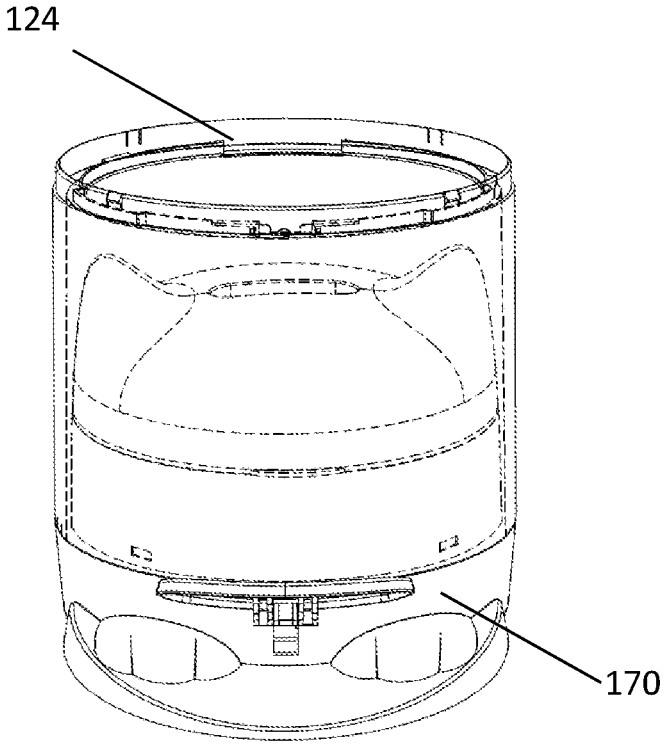
FIG. 39 illustrates further nesting of parts from the disassembled waste disposal container of FIG. 38, according to one aspect of the disclosed embodiments.

FIG. 39 shows the compact packaging of a base 170, on top of which is the top lid 110/bag roller body 122 assembly that is entirely nested within the upper portion 123 which is entirely nested within the lower portion 124. The contemplated inner support structure for this embodiment can be any of the above discussed inner support structure.

One way to make this possible is to have a slight tapered shape in either the upper portion 123, the lower portion 124, or both, such that there is a difference in their diameters so that one may fit within another. For example, top portion 123 of the outer casing 120 may have a top rim that has a smaller diameter than its bottom rim. In this way, the top rim of the upper portion 123 can fit through the bottom opening of the lower portion 124, which has an even bigger diameter.

In another example, bottom portion 124 of the outer casing 120 may have a top rim that has a smaller diameter than its bottom rim. In this way, the upper portion 123 would not fall into the lower portion 124 through the lower portion's top opening, but can fit through the bottom opening of the lower portion 124 which can have a bigger diameter than its top opening.

Another contemplated method of decreasing the shipping profile of a waste disposal container 100 is to have an outer casing 120 made of out of similar elements as the many embodiments of inner support shown and discussed in FIGS. 13-34. In other words, the outer casing 120 can also be made of a pliable liner propped up by a support frame work. In this way, the pliable liner and the support frame work can be easily disassembled for shipping and re-assembled by the end consumer.

While operations and/or assembly steps may be depicted in the drawings and described in a particular order, this should not be understood as requiring that such operations be performed in the particular order shown or in sequential order, or that all illustrated operations and/or method steps be performed, to achieve desirable results. In certain circumstances, multitasking and parallel processing may be advantageous.

Figure 40:
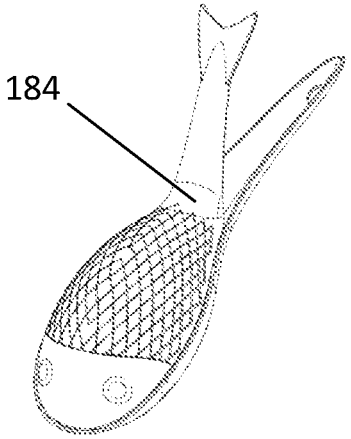
FIG. 40 is a perspective view a scooper from FIG. 1, according to one aspect of the disclosed embodiments.
Figure 41:
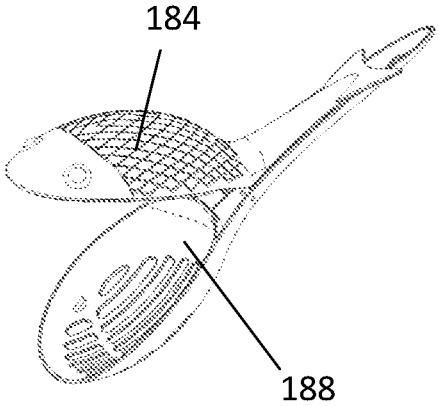
FIG. 41 is a perspective view a scooper from FIG. 40 in an open position, according to one aspect of the disclosed embodiments.
Figure 42:
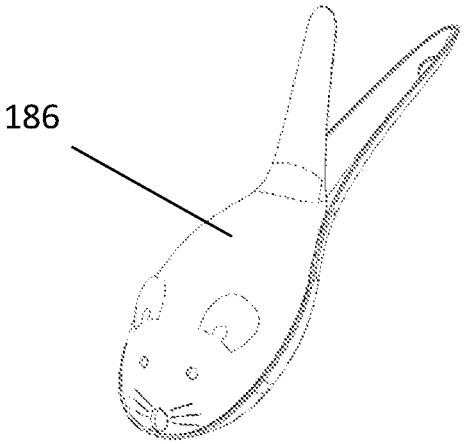
FIG. 42 is a perspective view another scooper, according to one aspect of the disclosed embodiments.
Figure 43:
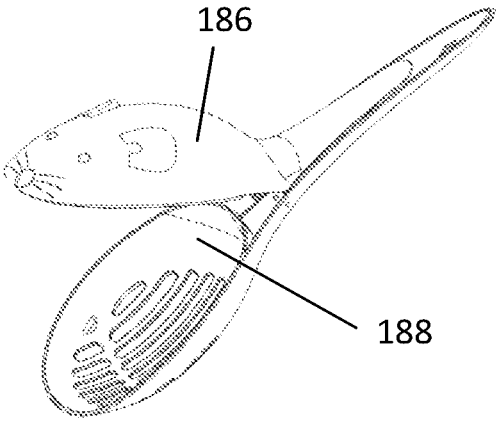
FIG. 43 is a perspective view the scooper from FIG. 42 in an open position, according to one aspect of the disclosed embodiments.

In FIGS. 40-43, two designs of the scooper 182 are shown. FIGS. 40 and 41 show a fish design scooper 182 having a top half 184 and a bottom half 188. FIGS. 42 and 43 show a mouse design scooper 182 having a top half 186 and a bottom half 188. The top half 184, 186 can be coupled to the bottom half 188 via a pivot joint, and is biased closed by a spring (not shown).

Figure 44:
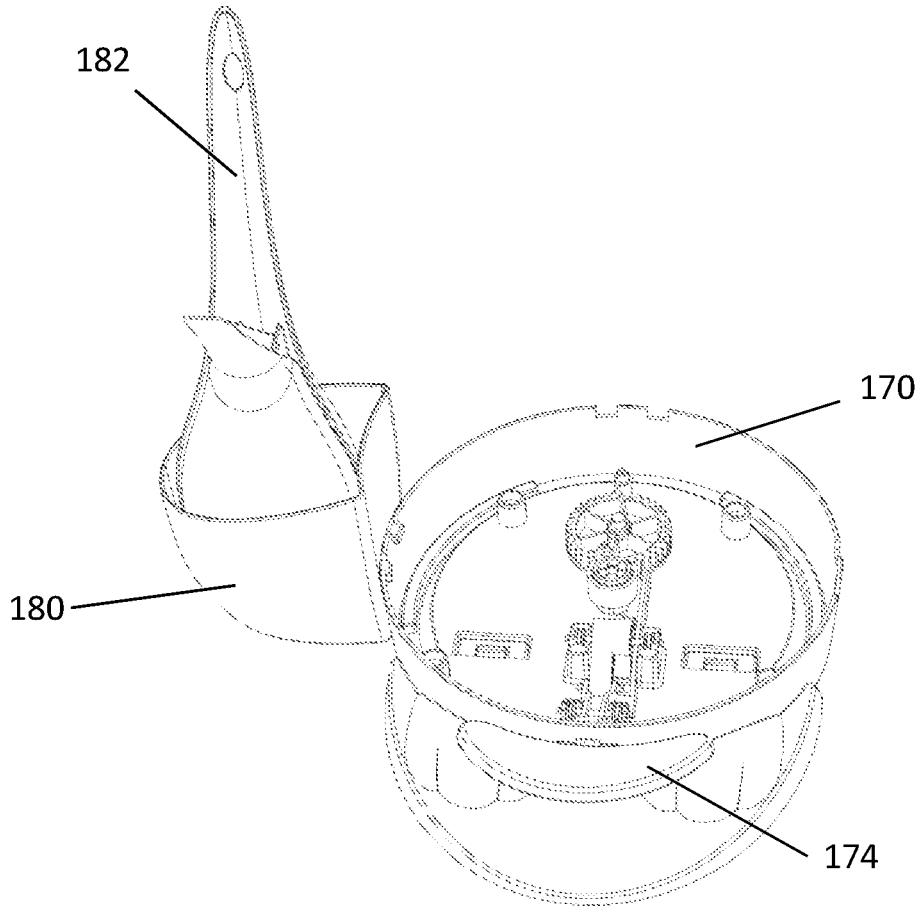
FIG. 44 is a perspective view of the base, according to one aspect of the disclosed embodiments.

FIG. 44 shows a base 170 without the rotating plate 174 installed, exposing the inner mechanics of the base 170. A scooper holder 180 can be attached to hold a scooper 182.

Figure 45:
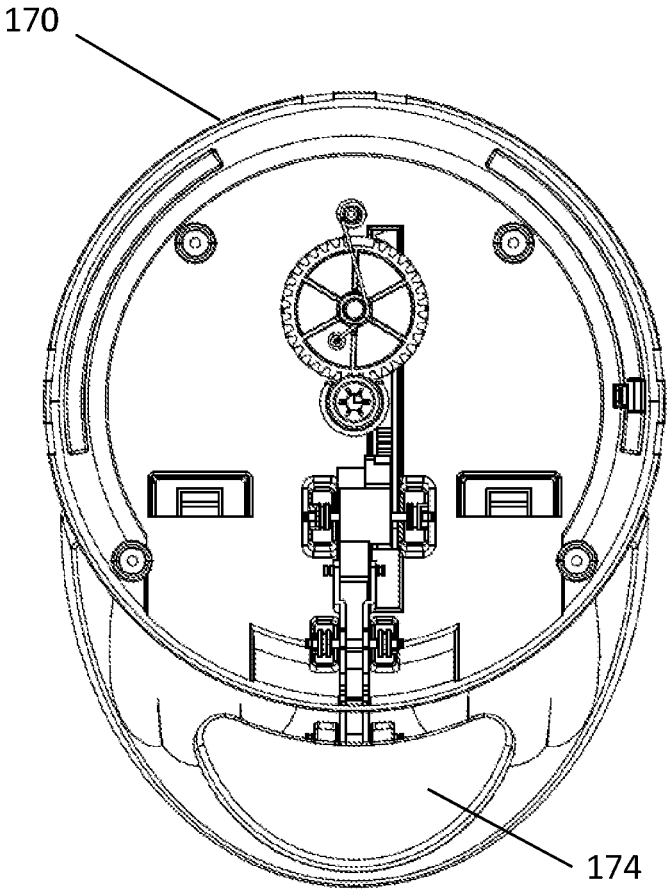
FIG. 45 is a top view of the base from FIG. 44, according to one aspect of the disclosed embodiments.
Figure 46:
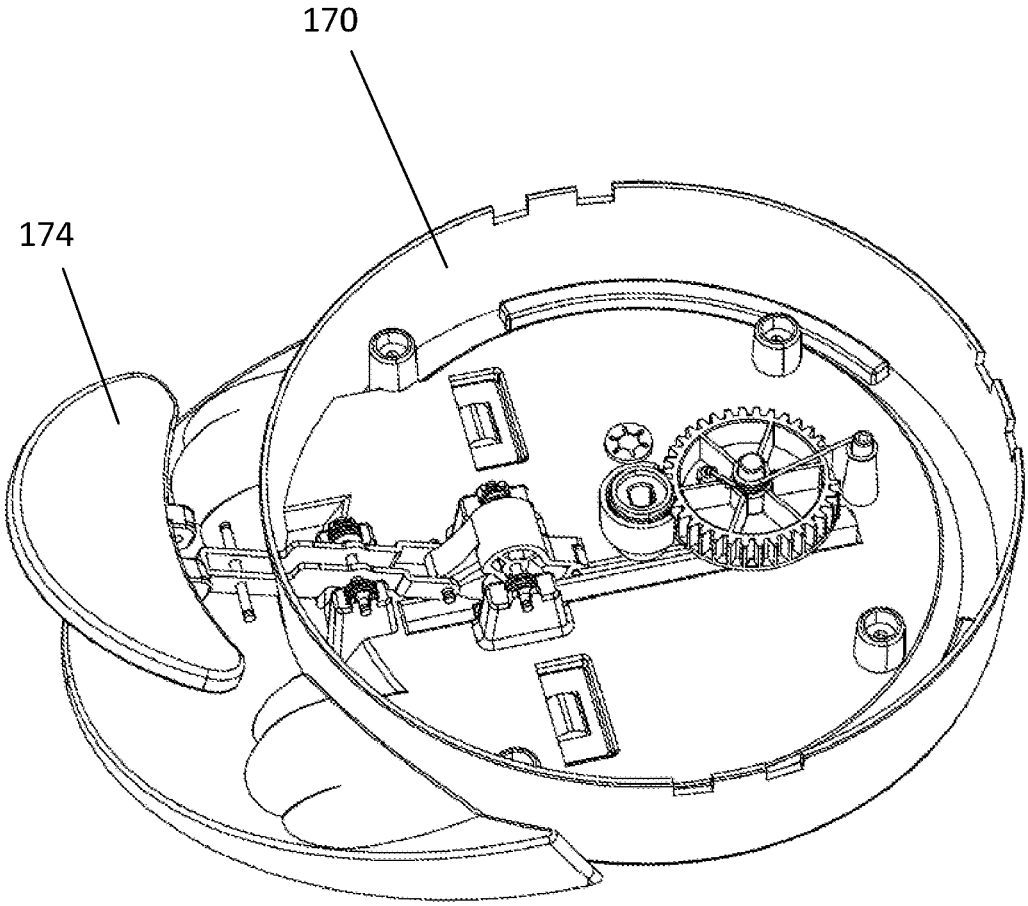
FIG. 46 is a perspective view of the base, according to one aspect of the disclosed embodiments.

FIGS. 45 and 46 reveal detail of the inner mechanics of the base 170 in a closer view.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

Thus, specific embodiments and applications of waste disposal container have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C and N, the text should be interpreted as requiring at least one element from the group which includes N, not A plus N, or B plus N, etc.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A waste disposal container, said container comprising:
- a base having a rotating plate capable of a rotational movement relative to the base;
- an actuator to control said rotational movement of the rotating plate;
- an outer casing coupled to the base;
- a top lid coupled to the outer casing;
- a support coupled to the rotating plate and is disposed interior to the outer casing;
- wherein the rotational movement of the rotating plate causes the support to rotate simultaneously;
- at least one catch coupled to the support to detachably attach to a disposable bag;
- a frame assembly coupled to the outer casing and disposed above the support, wherein the frame assembly comprises a roller base and a bag roller; wherein the bag roller is rotatable both clock-wise and counter clock-wise relative to the roller base;
- wherein a movement of the top lid is independent of the rotational movement of the rotating plate; and
- wherein the at least one catch is disposed at a height no taller than 60% of a height of the outer casing.

2. The waste disposal container as recited in claim 1, wherein a top rim of the disposable bag is fastened to the bag roller and the bag roller is capable of rotating at least 270 degrees relative to the roller base, thereby rotating the top rim of the disposable bag.

3. The waste disposal container as recited in claim 1, wherein the support includes at least one vertically raised rod.

4. The waste disposal container as recited in claim 3 further comprising a circular frame attached to the at least one vertically raised rod.

5. The waste disposal container as recited in claim 4 further comprising a circular wall coupled to the rotating plate.

6. The waste disposal container as recited in claim 4, wherein each of the at least one vertically raised rod is detachable.

7. The waste disposal container as recited in claim 1, wherein the support includes at least one vertically raised plate.

8. The waste disposal container as recited in claim 1, wherein the support includes a section of tubular pliable material, wherein said pliable material is selected from a group consisting of a fabric, a mesh, and a film.

9. The waste disposal container as recited in claim 1, wherein the support is a collapsible framework.

10. The waste disposal container as recited in claim 1, wherein the outer casing has an upper portion and a lower portion, both being physically separable from each other, and the upper portion is sized to fit within an inside of the lower portion, and the top lid is sized to fit within the inside of the lower portion and/or an inside of the upper portion.

11. A waste disposal container, said container comprising:
- a base having a rotating plate capable of a rotational movement relative to the base;
- an actuator to control said rotational movement of the rotating plate;
- an outer casing coupled to the base;
- a top lid coupled to the outer casing;
- a support coupled to the rotating plate and is disposed interior to the outer casing;
- wherein the rotational movement of the rotating plate causes the support to rotate simultaneously;
- at least one catch coupled to the support to detachably attach to a disposable bag;
- wherein a movement of the top lid is independent of the rotational movement of the rotating plate; and
- wherein the support includes at least one vertically raised rod.

12. The waste disposal container as recited in claim 11 further comprising a circular frame attached to the at least one vertically raised rod.

13. The waste disposal container as recited in claim 12 further comprising a circular wall coupled to the rotating plate.

14. The waste disposal container as recited in claim 12, wherein each of the at least one vertically raised rod is detachable.

15. The waste disposal container as recited in claim 14, wherein the outer casing has an upper portion and a lower portion, both being physically separable from each other, and the upper portion is sized to fit within an inside of the lower portion, and the top lid is sized to fit within the inside of the lower portion and/or an inside of the upper portion.

16. The waste disposal container as recited in claim 11, wherein the support includes a section of tubular pliable material, wherein said pliable material is selected from a group consisting of a fabric, a mesh, and a film.

17. A waste disposal container, said container comprising:
- a base having a rotating plate capable of a rotational movement relative to the base;
- an actuator to control said rotational movement of the rotating plate;
- an outer casing coupled to the base;
- a top lid coupled to the outer casing;
- a support coupled to the rotating plate and is disposed interior to the outer casing;

wherein the rotational movement of the rotating plate causes the support to rotate simultaneously;

at least one catch coupled to the support to detachably attach to a disposable bag, and;

wherein a movement of the top lid is independent of the rotational movement of the rotating plate; and wherein the support includes a section of tubular pliable material, wherein said pliable material is selected from a group consisting of a fabric, a mesh, and a film.

18. A waste disposal container, said container comprising:

a base having a rotating plate capable of a rotational movement relative to the base;

an actuator to control said rotational movement of the rotating plate;

an outer casing coupled to the base;

a top lid coupled to the outer casing;

a support coupled to the rotating plate and is disposed interior to the outer casing;

wherein the rotational movement of the rotating plate causes the support to rotate simultaneously;

at least one catch coupled to the support to detachably attach to a disposable bag, and; wherein a movement of the top lid is independent of the rotational movement of the rotating plate; and wherein the support is a collapsible framework.

19. The waste disposal container as recited in claim 18, wherein the collapsible framework includes a vertically raised rod.

20. A waste disposal container, said container comprising:

a base having a rotating plate capable of a rotational movement relative to the base;

an actuator to control said rotational movement of the rotating plate;

an outer casing coupled to the base;

a top lid coupled to the outer casing;

a support coupled to the rotating plate and is disposed interior to the outer casing;

wherein the rotational movement of the rotating plate causes the support to rotate simultaneously;

at least one catch coupled to the support to detachably attach to a disposable bag, and; wherein a movement of the top lid is independent of the rotational movement of the rotating plate; and wherein the outer casing has an upper portion and a lower portion, both being physically separable from each other, and the upper portion is sized to fit within an inside of the lower portion, and the top lid is sized to fit within the inside of the lower portion and/or an inside of the upper portion.

* * * * *